US008021008B2

(12) United States Patent
Ramer

(10) Patent No.: US 8,021,008 B2
(45) Date of Patent: Sep. 20, 2011

(54) SOLID STATE LIGHTING USING QUANTUM DOTS IN A LIQUID

(75) Inventor: David P. Ramer, Reston, VA (US)

(73) Assignee: ABL IP Holding LLC, Conyers, GA (US)

( * ) Notice: Subject to any disclaimer, the term of this patent is extended or adjusted under 35 U.S.C. 154(b) by 243 days.

(21) Appl. No.: 12/127,339

(22) Filed: May 27, 2008

(65) Prior Publication Data

US 2009/0296368 A1 Dec. 3, 2009

(51) Int. Cl.
*F21V 9/16* (2006.01)
*F21V 9/12* (2006.01)
*H01J 1/63* (2006.01)

(52) U.S. Cl. ..... 362/84; 362/293; 362/311.02; 362/318; 362/240; 362/241; 257/98; 313/501

(58) Field of Classification Search ..... 362/84–85, 362/293, 311.02, 318, 231, 240, 241, 249.02; 257/98; 313/501–512
See application file for complete search history.

(56) References Cited

U.S. PATENT DOCUMENTS 5,285,356 A * 2/1994 Skene et al. ..... 362/1
5,608,213 A 3/1997 Pinkus et al.
5,803,592 A 9/1998 Lawson
5,877,490 A 3/1999 Ramer et al.
5,914,487 A 6/1999 Ramer et al.
6,007,225 A 12/1999 Ramer et al.
6,045,238 A * 4/2000 Wheeler et al. ..... 362/247
6,068,383 A 5/2000 Robertson et al.
6,222,623 B1 4/2001 Wetherell
6,234,648 B1 5/2001 Borner et al.
6,280,054 B1 * 8/2001 Cassarly et al. ..... 362/231
6,286,979 B1 9/2001 Ramer et al.
6,357,889 B1 3/2002 Duggal et al.
6,361,192 B1 3/2002 Fussell et al.
6,422,718 B1 7/2002 Anderson et al.
6,437,861 B1 8/2002 Kuta
6,447,698 B1 9/2002 Ihara et al.
6,473,554 B1 10/2002 Pelka et al.
6,536,914 B2 3/2003 Hoelen et al.
6,566,824 B2 5/2003 Panagotacos et al.
6,672,741 B1 * 1/2004 Young ..... 362/311.02
6,682,211 B2 * 1/2004 English et al. ..... 362/545

(Continued)

FOREIGN PATENT DOCUMENTS

WO WO 2008/052318 A1 5/2008

OTHER PUBLICATIONS

International Search Report and the Written Opinion of the International Searching Authority issued in International Patent Application No. PCT/US2009/044025 dated Jul. 1, 2009.

(Continued)

*Primary Examiner* — Ismael Negron
(74) *Attorney, Agent, or Firm* — McDermott Will & Emery LLP

(57) ABSTRACT

A lighting apparatus includes a source of light of a first spectral characteristic, a reflector or a diffusely reflective chamber or cavity having a transmissive optical passage, and a liquid containing quantum dots. The quantum dots provide a wavelength shift of at least some light emitted by the source of light to produce a desired second spectral characteristic in the light output.

26 Claims, 12 Drawing Sheets

U.S. PATENT DOCUMENTS

| | | | | |
|---|---|---|---|---|
| 6,692,136 | B2 | 2/2004 | Marshall et al. | |
| 6,700,112 | B2 | 3/2004 | Brown | |
| 6,734,465 | B1 * | 5/2004 | Taskar et al. | 257/80 |
| 6,737,681 | B2 | 5/2004 | Koda | |
| 6,744,960 | B2 * | 6/2004 | Pelka | 385/130 |
| 6,836,083 | B2 | 12/2004 | Mukai | |
| 6,869,545 | B2 | 3/2005 | Peng et al. | |
| 6,872,249 | B2 | 3/2005 | Peng et al. | |
| 6,960,872 | B2 | 11/2005 | Beeson et al. | |
| 6,985,163 | B2 | 1/2006 | Riddle et al. | |
| 6,995,355 | B2 | 2/2006 | Rains, Jr. et al. | |
| 7,025,464 | B2 | 4/2006 | Beeson et al. | |
| 7,040,774 | B2 | 5/2006 | Beeson et al. | |
| 7,102,152 | B2 | 9/2006 | Chua et al. | |
| 7,105,051 | B2 | 9/2006 | Peng et al. | |
| 7,144,131 | B2 | 12/2006 | Rains | |
| 7,153,703 | B2 | 12/2006 | Peng et al. | |
| 7,160,525 | B1 | 1/2007 | Peng et al. | |
| 7,192,850 | B2 | 3/2007 | Chen et al. | |
| 7,220,039 | B2 | 5/2007 | Ahn et al. | |
| 7,235,190 | B1 | 6/2007 | Wilcoxon et al. | |
| 7,235,792 | B2 | 6/2007 | Elofson | |
| 7,273,904 | B2 | 9/2007 | Peng et al. | |
| 7,350,933 | B2 | 4/2008 | Ng et al. | |
| 7,374,807 | B2 | 5/2008 | Parce et al. | |
| 7,531,149 | B2 | 5/2009 | Peng et al. | |
| 7,560,677 | B2 | 7/2009 | Lyons et al. | |
| 7,600,882 | B1 * | 10/2009 | Morejon et al. | 362/84 |
| 7,712,918 | B2 * | 5/2010 | Siemiet et al. | 362/241 |
| 2003/0016536 | A1 * | 1/2003 | Lin | 362/250 |
| 2003/0034985 | A1 * | 2/2003 | Riddle et al. | 345/589 |
| 2004/0151008 | A1 | 8/2004 | Artsyukhovich et al. | |
| 2004/0188594 | A1 | 9/2004 | Brown et al. | |
| 2004/0233664 | A1 * | 11/2004 | Beeson et al. | 362/231 |
| 2006/0072314 | A1 | 4/2006 | Rains | |
| 2006/0170335 | A1 * | 8/2006 | Cho et al. | 313/501 |
| 2007/0018558 | A1 * | 1/2007 | Chua et al. | 313/485 |
| 2007/0045524 | A1 | 3/2007 | Rains, Jr. et al. | |
| 2007/0051883 | A1 | 3/2007 | Rains, Jr. et al. | |
| 2007/0138978 | A1 | 6/2007 | Rains, Jr. et al. | |
| 2007/0170454 | A1 | 7/2007 | Andrews | |
| 2007/0242441 | A1 | 10/2007 | Aldrich et al. | |
| 2008/0030974 | A1 | 2/2008 | Abu-Ageel | |
| 2008/0094835 | A1 | 4/2008 | Marra et al. | |
| 2008/0106887 | A1 | 5/2008 | Salsbury et al. | |
| 2008/0224025 | A1 | 9/2008 | Lyons et al. | |
| 2009/0003002 | A1 | 1/2009 | Sato | |
| 2009/0295266 | A1 | 12/2009 | Ramer et al. | |

OTHER PUBLICATIONS

Pradhan, Narayan, et al., "An Alternative of CdSe Nanocrystal Emitters: Pure and Tunable Impurity Emissions in ZnSe Nonocrystals", Nov. 24, 2005, 127, pp. 17586-17587, J. A, Chem, Soc. Communications, web publication.

"Energy Star Program Requirements for Solid State Lighting Luminaires Eligibility Criteria—Version 1.0", Manual, Sep. 12, 2007.

Yin, Yadong and A. Paul Alivisatos, "Colloidal nanocrystal sythesis and the organic-inorganic interface", Insight Review, Sep. 25, 2005, pp. 664-670, Nature vol. 437.

"Final Report: Highly Bright, Heavy Metal-Free, and Stable Doped Semiconductor Nanophosphors for Economical Solid State Lighting Alternatives", Report, Nov. 12, 2009, pp. 1-3, National Center for Environmental Research, web publication.

"Solid-State Lighting: Development of White LEDs Using Nanophosphor-InP Blends", Report, Oct. 26, 2009, p. 1, U.S. Department of Energy—Energy Efficient and Renewable Energy, web publication.

"Solid-State Lighting: Improved Light Extraction Efficiencies of White pc-LEDs for SSL by Using Non-Toxic, Non-Scattering, Bright, and Stable Doped ZnSe Quantum Dot Nanophosphors (Phase I)", Report, Oct. 26, 2009,pp. 1-2, U.S. Department of Energy—Energy Efficiency and Renewable Energy, web publication.

"Chemistry—All in the Dope", Editor's Choice, Dec. 9, 2005, Science, vol. 310, p. 1, AAAS, web publication.

"D-dots: Heavy Metal Free Doped Semiconductor Nanocrystals", Technical Specifications, etc. Dec. 1, 2009, pp. 1-2, NN-LABS, LLC (Nanomaterials & Nanofabrication Laboratories), CdSe/ZnS Semiconductor Nanocrystals, web publication.

Notification Concerning Transmittal of International Preliminary Report of Patentability issued in International Application No. PCT/US2009/044025 dated Dec. 9, 2010.

European Search Report issued in European Patent Application No. 09755624.5-2423, mailed Apr. 20, 2011.

United States Office Action issued in U.S. Appl. No. 12/729,887 dated Jun. 21, 2011.

* cited by examiner

SOLID STATE LIGHTING USING QUANTUM DOTS IN A LIQUID

TECHNICAL FIELD

The present subject matter relates to solid state type light fixtures, systems incorporating such light fixtures, as well as techniques for manufacturing and operating such equipment for general lighting, in which quantum dot materials in liquid are used to shift at least some electromagnetic energy so that the equipment produces a desired spectral characteristic in the light emitted for a general lighting application.

BACKGROUND

As costs of energy increase along with concerns about global warming due to consumption of fossil fuels to generate energy, there is an every increasing need for more efficient lighting technologies. These demands, coupled with rapid improvements in semiconductors and related manufacturing technologies, are driving a trend in the lighting industry toward the use of light emitting diodes (LEDs) or other solid state light sources to produce light for general lighting applications, as replacements for incandescent lighting and eventually as replacements for other older less efficient light sources.

The actual solid state light sources, however, produce light of specific limited spectral characteristics. To obtain white light of a desired characteristic and/or other desirable light colors, lighting devices based on solid state sources have typically used sources that produce light of two or more different colors or wavelengths. One technique involves mixing or combining individual light from LEDs of three or more different wavelengths (single or "primary" colors), for example from Red, Green and Blue LEDs. Another approach combines a white LED source, which tends to produce a cool bluish light, with one or more LEDs of specific wavelength(s) such as red and/or yellow chosen to shift a combined light output to a more desirable color temperature. Adjustment of the LED outputs offers control of intensity as well as the overall color output, e.g. color and/or color temperature of white light.

To provide efficient mixing of the various colors of the light and a pleasing uniform light output, Advanced Optical Technologies, LLC (AOT) of Herndon, Va. has developed a variety of light fixture configurations that utilize a diffusely reflective optical integrating cavity to process and combine the light from a number of solid state sources. By way of example, a variety of structures for AOT's lighting systems using optical integrating cavities are described in US Patent Application Publications 2007/0138978, 2007/0051883 and 2007/0045524, the disclosures of which are incorporated herein entirely by reference.

In recent years, techniques have also been developed to shift or enhance the characteristics of light generated by solid state sources using phosphors, including for generating white light using LEDs. Phosphor based techniques for generating white light from LEDs, currently favored by LED manufacturers, include UV or Blue LED pumped with phosphors and quantum dots pumped with UV LEDs.

There are a variety of structures and techniques that use phosphor to enhance the characteristics of the LED light output, although such techniques typically operate in one of two ways, as summarized below. In a UV LED that pumps RGB phosphors or quantum dots, non-visible UV light excites the mixture of red-green-blue phosphors or dots to emit light across the visible spectrum. There is no direct contribution of visible light from the UV LED semiconductor chip. In the other typical approach, a Blue LED is pumped with one or more phosphors or dots within the LED package. Some of the blue light from a blue LED chip (460 nm) excites the phosphor or dots to emit yellow light and then the rest of the blue light is mixed with the yellow to make white light, albeit of cool bluish character. Additional phosphors or dots can be used to improve the spectral characteristics. In either case, the phosphor or quantum dots material typically has been integrated directly into the LED and/or its package, for example by doping a portion of the package or by coating the portion of the package through which the light emerges. Phosphors have also been used on reflectors or transmissive layers inside of the package containing the actual LED chip.

AOT has also proposed to utilize phosphors, including quantum dot phosphors, on macro-scale components of their cavity based fixture optics. Their U.S. Pat. No. 7,144,131, the disclosure of which is incorporated herein entirely by reference, for example proposed improvements to semiconductor-based systems for generating white light, by integrating the phosphor into a reflective material of an external structure. In a disclosed example using an optical integrating cavity for lighting applications, one or more solid state energy source packages (typically LEDs) emit light energy of a first wavelength. In the cavity example, the cavity comprises a diffuse reflector outside the LED package(s) that has a diffusely reflective surface arranged to receive light energy from the source(s). At least some of that light energy of the first wavelength excites one or more phosphors or dots doped within the cavity reflector to emit visible light, including visible light energy of at least one second wavelength different from the first wavelength. Visible light emitted by the phosphor or dots is reflected by the diffuse surface of the reflector, and thereby integrated in the cavity. The integrated light may include some visible light from the solid state source(s). The optical aperture of the reflector/cavity (and possibly one or more additional downstream optical processing elements) directs the integrated light, including light from the phosphors or quantum dots, to facilitate the particular general lighting application.

As noted above, the phosphors used in solid state lighting may include quantum dots, sometimes referred to as nano phosphors or nano crystals or as quantum dot phosphors. Quantum dots are nano scale semiconductor particles, typically crystalline in nature, which absorb light of one wavelength and re-emit light at a different wavelength, much like conventional phosphors. However, unlike conventional phosphors, optical properties of the quantum dots can be tailored as a function of the size of the dots. In this way, for example, it is possible to adjust the absorption spectrum and/or the emission spectrum of the quantum dots by controlling crystal formation during the manufacturing process so as to change the size of the quantum dots. Thus, quantum dots of the same material, but with different sizes, can absorb and/or emit light of different colors. For at least some exemplary quantum dot materials, the larger the dots, the redder the spectrum of re-emitted light; whereas smaller dots produce a bluer spectrum of re-emitted light. Performance of some quantum dots may be tailored by other means. These unique characteristics make quantum dots particularly attractive for solid state lighting where a specifically tailored color shift of some of the light may be desired, in order to provide a desired spectral characteristic in white light or to otherwise shift the color of the light output produced from limited numbers of wavelengths in the light from the solid state sources, including for general lighting applications.

As typically utilized in various lighting applications, quantum dots are confined in some form of solid structure, e.g. as a paint or solid surface coating or otherwise doped into a material of a substrate. In such a solid matrix, the efficiency of quantum dot materials remains relatively low, e.g. around 30% or less. Use of such inefficient materials in general lighting applications reduces the benefits otherwise obtained by use of a solid state light emitter as the light source.

Hence a need exists for a technique to improve efficiency of operations of quantum dot materials in general lighting applications. It is known that quantum dots in liquids exhibit higher efficiencies than in solids, however, there has been no suggestion of a practical way to utilize quantum dots in a liquid in the context of a solid state lighting device, particularly one adapted for a general lighting application.

SUMMARY

Various teachings or examples discussed herein alleviate one or more of the above noted problems with solid state lighting devices or systems that utilize quantum dots, by providing the quantum dots in a liquid as part of a fixture having a diffusely reflective chamber or integrating cavity.

A lighting apparatus for example may provide general lighting in a region or area intended to be occupied by a person. The apparatus includes a source of light of a first spectral characteristic of sufficient light intensity for a general lighting application. The apparatus also includes a chamber having a diffusely reflective interior surface and a transmissive optical passage, for receiving and diffusing light from the source. Multiple diffuse reflections from the reflective interior surface form processed light for emission via the optical passage, in a direction to facilitate said general lighting application in the region or area. The apparatus further comprises a liquid containing quantum dots, for producing a wavelength shift of at least some light, so as to produce a desired second color characteristic in the processed light emitted from the optical passage of the chamber.

As noted, the intensity of light produced by the light source, e.g. one or more solid state light emitters or a lamp, is sufficient for the light output of the apparatus to support the general lighting application. Examples of general lighting applications include downlighting, task lighting, "wall wash" lighting, emergency egress lighting, as well as illumination of an object or person in a region or area intended to be occupied by people. A task lighting application, for example, typically requires a minimum of approximately 20 foot-candles (fcd) on the surface or level at which the task is to be performed, e.g. on a desktop or countertop. In a room, where the light fixture is mounted in or hung from the ceiling or wall and oriented as a downlight, for example, the distance to the task surface or level can be 35 inches or more below the output of the light fixture. At that level, the light intensity will still be 20 fcd or higher for task lighting to be effective.

In several examples, the light source comprises one or a plurality of solid state light emitters, such as light emitting diodes. Examples are also discussed which use other light sources, such as a mercury vapor lamp.

The chamber in several examples discussed in more detail below is an optical integrating cavity having a diffusely reflective interior surface and a transmissive optical passage for emission of integrated light. The optical integrating cavity and/or the optical passage may have a variety of different shapes, to facilitate different applications. Examples of the cavity may be similar to hemispheres or half cylinders (or other portions of spheres or cylinders), although square, rectangular, conical, pyramidal and other shapes may be used. Where the cavity is a segment of a sphere, the optical passage often will be circular. Where the cavity is a segment of a cylinder, the optical passage often is rectangular. The examples also disclose a variety of different containment configurations and/or positions for the quantum dot liquid.

The disclosure below also discusses a lighting apparatus for general lighting that includes a source and a reflector. The source provides light of a first spectral characteristic of sufficient light intensity for a general lighting application. The reflector has a reflective interior surface for directing light from the source in a direction to facilitate the general lighting application in a region or area. The apparatus also includes a liquid containing quantum dots, for producing a wavelength shift of at least some of the light.

The chamber or reflector with the diffusely reflective surface facilitates use of the quantum dots in the liquid state. The liquid state offers much higher efficiency in conversion of light of one wavelength to light of another more desirable wavelength. Efficiency may be as high as 90% for some quantum dots in a liquid. Hence, the combination of the chamber and the quantum dot liquid provides a particularly efficient general lighting apparatus.

Additional advantages and novel features will be set forth in part in the description which follows, and in part will become apparent to those skilled in the art upon examination of the following and the accompanying drawings or may be learned by production or operation of the examples. The advantages of the present teachings may be realized and attained by practice or use of various aspects of the methodologies, instrumentalities and combinations set forth in the detailed examples discussed below.

BRIEF DESCRIPTION OF THE DRAWINGS

The drawing figures depict one or more implementations in accord with the present teachings, by way of example only, not by way of limitation. In the figures, like reference numerals refer to the same or similar elements.

FIGS. 5D-1 to 5D-4 are enlarged cross sectional detail (D) views of a portion of the fixture of FIG. 5 at the location indicated by the oval D, showing different textures at surfaces of several components of the fixture for several different examples.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and circuitry have been described at a relatively high-level, without detail, in order to avoid unnecessarily obscuring aspects of the present teachings. Generally, the illustrations in the figures are not drawn to scale, but instead are sized to conveniently show various points under discussion herein.

The various examples discussed below relate to lighting fixtures or apparatuses using solid state light sources and/or to lighting systems incorporating such devices, in which the apparatus includes a liquid containing quantum dots. Reference now is made in detail to the examples illustrated in the accompanying drawings and discussed below.

Figure 1:
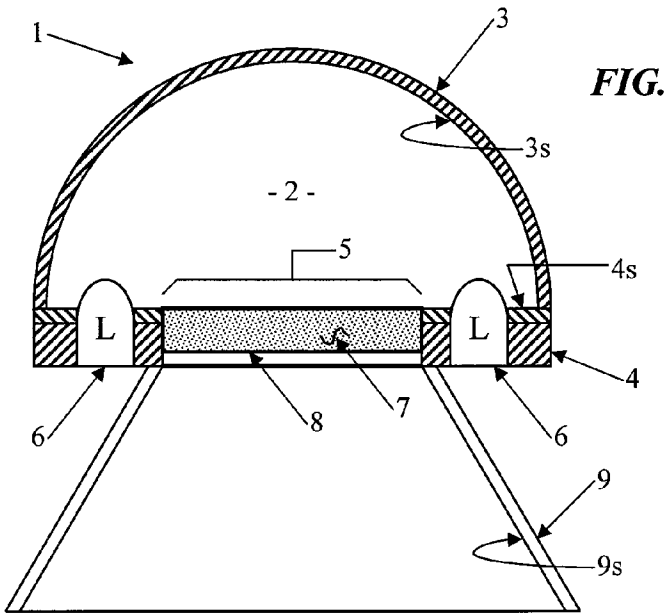
FIG. 1 is a cross section of a light fixture for a general lighting application, using solid state light emitters, an optical integrating cavity, a deflector or concentrator and a liquid containing quantum dots.

FIG. 1 illustrates a first example of a lighting fixture or apparatus having solid state light sources, an optical integrating chamber and a liquid containing quantum dots. At a high level, the solid state lighting fixture 1 of FIG. 1 includes a chamber, in this example, an optical integrating cavity 2 formed by a dome 3 and a plate 4. The cavity 2 has a diffusely reflective interior surface a 3*s* and/or 4*s* and a transmissive optical passage 5. The lighting apparatus 1 also includes a source of light of a first spectral characteristic of sufficient light intensity for a general lighting application, in this example, two or more solid state light sources 6. The lighting fixture 1 utilizes quantum dots in a liquid 7 within a container 8, for producing a wavelength shift of at least some light from the source(s) 6 to produce a desired color characteristic in the processed light emitted from the optical passage 5 of the chamber 2.

The intensity of light produced by the light source, e.g. the solid state light emitter(s) or a lamp, is sufficient for the light output of the apparatus to support the general lighting application. Examples of general lighting applications include downlighting, task lighting, "wall wash" lighting, emergency egress lighting as well as illumination of an object or person in a region or area intended to be occupied by people. A task lighting application, for example, typically requires a minimum of approximately 20 foot-candles (fcd) on the surface or level at which the task is to be performed, e.g. on a desktop or countertop. In a room, where the light fixture is mounted in or hung from the ceiling or wall and oriented as a downlight, for example, the distance to the task surface or level can be 35 inches or more below the output of the light fixture. At that level, the light intensity will still be 20 fcd or higher for effective task lighting.

In most of the examples, for convenience, the lighting apparatus is shown emitting the light downward from the aperture, possibly via an additional optical processing element such as a deflector or concentrator (e.g. deflector 9 in FIG. 1). However, the apparatus may be oriented in any desired direction to perform a desired general lighting application function. The aperture or a further optical processing element may provide the ultimate output of the apparatus for a particular general lighting application. As discussed in detail with regard to FIG. 1, but applicable to all of the examples, circular or hemispherical shapes are shown and discussed most often for convenience, although a variety of other shapes may be used.

Hence, as shown in FIG. 1, an exemplary general lighting apparatus or fixture 1 includes an optical integrating cavity 2 having a reflective interior surface. The cavity 2 is a diffuse optical processing element used to convert a point source input, typically at an arbitrary point not visible from the outside, to a virtual source. At least a portion of the interior surface of the cavity 2 exhibits a diffuse reflectivity.

The cavity 2 may have various shapes. The illustrated cross-section would be substantially the same if the cavity is hemispherical or if the cavity is semi-cylindrical with a lateral cross-section taken perpendicular to the longitudinal axis of the semi-cylinder. For purposes of the discussion, the cavity 2 in the fixture 1 is assumed to be hemispherical or nearly hemispherical. In such an example, a hemispherical dome 3 and a substantially flat cover plate 4 form the optical cavity 2. Although shown as separate elements, the dome and plate may be formed as an integral unit. The plate is shown as a flat horizontal member, for convenience, although curved or angled configurations may be used. At least the interior facing surface(s) 3*s* of the dome 3 is highly diffusely reflective, so that the resulting cavity 2 is highly diffusely reflective with respect to the radiant energy spectrum produced by the system 1. The interior facing surface(s) 4*s* of the plate 4 is reflective, typically specular or diffusely reflective. In the example, the dome 3 itself is formed of a diffusely reflective material, whereas the plate 4 may be a circuit board or the like on which a coating or layer of reflective material is added or mounted to form the reflective surface 4*s*.

It is desirable that the diffusely reflective cavity surface(s) have a highly efficient reflective characteristic, e.g. a reflectivity equal to or greater than 90%, with respect to the relevant wavelengths. The entire interior surface (surfaces 3*s*, 4*s* of the dome and plate) may be diffusely reflective, or one or more substantial portions may be diffusely reflective while other portion(s) of the cavity surface may have different light reflective characteristics. In some examples, one or more other portions are substantially specular or are semi or quasi specular.

The elements 3 and 4 of the cavity 2 may be formed of a diffusely reflective plastic material, such as a polypropylene having a 97% reflectivity and a diffuse reflective characteristic. Such a highly reflective polypropylene is available from Ferro Corporation—Specialty Plastics Group, Filled and Reinforced Plastics Division, in Evansville, Ind. Another example of a material with a suitable reflectivity is SPECTRALON. Alternatively, each element of the optical integrating cavity may comprise a rigid substrate having an interior surface, and a diffusely reflective coating layer formed on the interior surface of the substrate so as to provide the diffusely reflective interior surface of the optical integrating cavity. The coating layer, for example, might take the form of a flat-white paint or white powder coat. A suitable paint might include a zinc-oxide based pigment, consisting essentially of an uncalcined zinc oxide and preferably containing a small amount of a dispersing agent. The pigment is mixed with an alkali metal silicate vehicle-binder, which preferably is a potassium silicate, to form the coating material. For more information regarding exemplary paints, attention is directed to U.S. Pat. No. 6,700,112 by Matthew Brown. Of course, those skilled in the art will recognize that a variety of other diffusely reflective materials may be used.

In this example, the cavity 2 forms an integrating type optical cavity. The cavity 2 has a transmissive optical aperture 5, which allows emission of reflected and diffused light from within the interior of the cavity 2 into a region to facilitate a humanly perceptible general lighting application for the fixture 1. Although shown at approximately the center of the plate 4, the opening or transmissive passage forming the optical aperture 5 may be located elsewhere along the plate or at some appropriate region of the dome. In the example, the aperture 5 forms the virtual source of the light from lighting apparatus or fixture 1. As discussed more later, the fixture 1 includes a quantum dot liquid 7. Although the liquid may be provided in a number of different ways, in this first example, a container 8 of quantum dot liquid 7 is mounted in the aperture 5.

The lighting fixture 1 also includes at least one source of light energy. The fixture geometry may be used with any appropriate type of solid state light sources, and in some cases discussed later, the fixture may utilize other types of light sources. Although other types of sources of light energy may be used, where there is a need or desire for a color shift using quantum dots, such as various conventional forms of incandescent, arc, neon and fluorescent lamp, in this first example, the source takes the form of one or more light emitting diodes (L), represented by the two LEDs (L) 6 in the drawing. The LEDs (L) 6 may emit a single type of visible light, a number of colors of visible light or a combination of visible light and at least one light wavelength in another part of the electromagnetic spectrum selected to pump the quantum dots.

The LEDs (L) 6 may be positioned at a variety of different locations and/or oriented in different directions. Various couplings and various light entry locations may be used. In this and other examples, each LED (L) 6 is coupled to supply light to enter the cavity 2 at a point that directs the light toward a reflective surface so that it reflects one or more times inside the cavity 2, and at least one such reflection is a diffuse reflection. As a result, the direct emissions from the sources 6 would not directly pass through the optical aperture 5, or in this example, directly impact on the liquid 7 in the container 8 mounted in the aperture 5. In examples where the aperture is open or transparent, the points of emission into the cavity are not directly observable through the aperture 5 from the region illuminated by the fixture output. The LEDs (L) 6 therefore are not perceptible as point light sources of high intensity, from the perspective of an area illuminated by the light fixture 1.

As discussed herein, applicable solid state light emitting elements (S) essentially include any of a wide range of light emitting or generating devices formed from organic or inorganic semiconductor materials. Examples of solid state light emitting elements include semiconductor laser devices and the like. Many common examples of solid state lighting elements, however, are classified as types of "light emitting diodes" or "LEDs." This exemplary class of solid state light emitting devices encompasses any and all types of semiconductor diode devices that are capable of receiving an electrical signal and producing a responsive output of electromagnetic energy. Thus, the term "LED" should be understood to include light emitting diodes of all types, light emitting polymers, organic diodes, and the like. LEDs may be individually packaged, as in the illustrated examples. Of course, LED based devices may be used that include a plurality of LEDs within one package, for example, multi-die LEDs that contain separately controllable red (R), green (G) and blue (B) LEDs within one package. Those skilled in the art will recognize that "LED" terminology does not restrict the source to any particular type of package for the LED type source. Such terms encompass LED devices that may be packaged or non-packaged, chip on board LEDs, surface mount LEDs, and any other configuration of the semiconductor diode device that emits light. Solid state lighting elements may include one or more phosphors and/or quantum dots, which are integrated into elements of the package or light processing elements of the fixture to convert at least some radiant energy to a different more desirable wavelength or range of wavelengths.

The color or spectral characteristic of light or other electromagnetic radiant energy relates to the frequency and wavelength of the radiant energy and/or to combinations of frequencies/wavelengths contained within the energy. Many of the examples relate to colors of light within the visible portion of the spectrum, although examples also are discussed that utilize or emit other energy. Electromagnetic energy, typically in the form of light energy from the one or more LEDs (L) 6, is diffusely reflected and combined within the cavity 2 to form combined light and form a virtual source of such combined light at the aperture 5. Such integration, for example, may combine light from multiple sources or spread light from one small source across the broader area of the aperture 5. The integration tends to form a relatively Lambertian distribution across the virtual source. When the fixture illumination is viewed from the area illuminated by the combined light, the virtual source at aperture 5 appears to have substantially infinite depth of the integrated light. Also, the visible intensity is spread uniformly across the virtual source, as opposed to one or more individual small point sources of higher intensity as would be seen if the one or more LED source elements (L) 6 were directly observable without sufficient diffuse processing before emission through the aperture 5.

Pixelation and color striation are problems with many prior solid state lighting devices. When a non-cavity type LED fixture output is observed, the light output from individual LEDs or the like appear as identifiable/individual point sources or 'pixels.' Even with diffusers or other forms of common mixing, the pixels of the sources are apparent. The observable output of such a prior system exhibits a high maximum-to-minimum intensity ratio. In systems using multiple light color sources, e.g. RGB LEDs, unless observed from a substantial distance from the fixture, the light from the fixture often exhibits striations or separation bands of different colors.

Systems and light fixtures as disclosed herein, however, do not exhibit such pixilation or striations. Instead, the diffuse optical processing in the chamber converts the point source output(s) of the one or more solid state light emitting elements to a virtual source output of light, at the aperture 5 in the examples using optical cavity processing. The virtual source output is unpixelated and relatively uniform across the apparent output area of the fixture, e.g. across the optical aperture 5 of the cavity 2 and/or across the container 8 in the aperture in this first example (FIG. 1). The optical integration sufficiently mixes the light from the solid state light emitting elements 6 that the combined light output of the virtual source is at least substantially Lambertian in distribution across the optical output area of the cavity, that is to say across the aperture 5 of the cavity 2. As a result, the light output exhibits a relatively low maximum-to-minimum intensity ratio across the aperture 5. In virtual source examples discussed herein, the virtual source light output exhibits a maximum to minimum ratio of 2 to 1 or less over substantially the entire optical output area. The area of the virtual source is at least one order of magnitude larger than the area of the point source output of the solid state emitter 6. The virtual source examples rely on various implementations of the optical integrating cavity 2 as the mixing element to achieve this level of output uniformity at the virtual source, however, other mixing elements could be used if they are configured to produce a virtual source with such a uniform output (Lambertian and/or relatively low maximum-to-minimum intensity ratio across the fixture's optical output area).

The diffuse optical processing may convert a single small area (point) source of light from a solid state emitter 6 to a broader area virtual source at the aperture. The diffuse optical processing can also combine a number of such point source outputs to form one virtual source. The quantum dots are used to shift color with respect to at least some light output of the virtual source.

It also should be appreciated that solid state light emitting elements 6 may be configured to generate electromagnetic radiant energy having various bandwidths for a given spectrum (e.g. narrow bandwidth of a particular color, or broad bandwidth centered about a particular), and may use different configurations to achieve a given spectral characteristic. For example, one implementation of a white LED may utilize a number of dies that generate different primary colors which combine to form essentially white light. In another implementation, a white LED may utilize a semiconductor that generates light of a relatively narrow first spectrum in response to an electrical input signal, but the narrow first spectrum acts as a pump. The light from the semiconductor "pumps" a phosphor material or quantum dots contained in the LED package, which in turn radiates a different typically broader spectrum of light that appears relatively white to the human observer.

In accord with the present teachings, the fixture 1 also includes a liquid 7 containing quantum dots. Other arrangements of the liquid are discussed later, but in this first example, fixture 1 includes a container 8 containing the liquid 7, and the container 8 is located in the aperture 5.

Phosphors absorb excitation energy then re-emit the energy as radiation of a different wavelength than the initial excitation energy. For example, some phosphors produce a down-conversion referred to as a "Stokes shift," in which the emitted radiation has less quantum energy and thus a longer wavelength. Other phosphors produce an up-conversion or "Anti-Stokes shift," in which the emitted radiation has greater quantum energy and thus a shorter wavelength. Quantum dots provide similar shifts in wavelengths of light. As noted earlier, however, quantum dots have the advantage that optical performance, including absorption and/or emission spectra, can be tailored, for example, by carefully selecting the size of the quantum dots.

Based on these principles, the liquid 7 in the lighting fixture 1 includes quantum dots sized to provide a color shift that is desirable, for the general lighting application of the fixture 1. For example, if the LEDs (L) 6 produce an integrated light output of a bluish character, which persons might perceive as somewhat "cool," the quantum dots in the liquid 7 could be selected to increase the amount of yellow and/or red light in the virtual source output and thereby produce a somewhat "warmer" color of white light. In this discussion, the temperature references are relative to human perceptions. Scientifically, however, the color temperature of the bluish light is actually higher.

The shift provided by the quantum dots in liquid 7 may also serve to shift light energy into the visible portion of the spectrum. For example, if one or more of the LEDs (L) 6 emit UV light, the quantum dots of appropriate materials and sizes could shift that light to one or more desirable wavelengths in the visible portion of the spectrum.

The aperture 5 (and/or passage through liquid 7 and container 8) may serve as the light output if the fixture 1, directing integrated color light of relatively uniform intensity distribution to a desired area or region to be illuminated in accord with the general lighting application. It is also contemplated that the fixture may include one or more additional processing elements coupled to the aperture, such as a colliminator, a grate, lens or diffuser (e.g. a holographic element). In the first example, the fixture 1 includes a further optical processing element in the form of a deflector or concentrator 9 coupled to the aperture 5, to distribute and/or limit the light output to a desired field of illumination.

The deflector or concentrator 9 has a reflective inner surface 9*s*, to efficiently direct most of the light emerging from the cavity and the liquid into a relatively narrow field of view. A small opening at a proximal end of the deflector 9 is coupled to the aperture 5 of the optical integrating cavity 2. The deflector 9 has a larger opening at a distal end thereof. Although other shapes may be used, such as parabolic reflectors, the deflector 9 in this example is conical, essentially in the shape of a truncated cone. The angle of the cone wall(s) and the size of the distal opening of the conical deflector 9 define an angular field of light energy emission from the apparatus 1. Although not shown, the large opening of the deflector may be covered with a transparent plate or lens, or covered with a grating, to prevent entry of dirt or debris through the cone into the fixture 1 and/or to further process the output light energy.

The conical deflector 9 may have a variety of different shapes, depending on the particular lighting application. In the example, where cavity 2 is hemispherical, the cross-section of the conical deflector 9 is typically circular. However, the deflector 9 may be somewhat oval in shape. Although the aperture 5 may be round, the distal opening may have other shapes (e.g. oval, rectangular or square); in which case, more curved deflector walls provide a transition from round at the aperture coupling to the alternate shape at the distal opening. In applications using a semi-cylindrical cavity, the deflector may be elongated or even rectangular in cross-section. The shape of the aperture 5 also may vary, but will typically match the shape of the small end opening of the deflector 9. Hence, in the example, the aperture 5 would be circular as would the matching proximal opening at the small end of the conical deflector 9. However, for a device with a semi-cylindrical cavity and a deflector with a rectangular cross-section, the aperture and associated deflector opening may be rectangular with square or rounded corners.

The deflector 9 comprises a reflective interior surface 9*s* between the distal end and the proximal end. In some examples, at least a substantial portion of the reflective interior surface 9*s* of the conical deflector 9 exhibits specular reflectivity with respect to the integrated radiant energy. As discussed in U.S. Pat. No. 6,007,225, for some applications, it may be desirable to construct the deflector 9 so that at least some portion(s) of the inner surface 9*s* exhibit diffuse reflectivity or exhibit a different degree of specular reflectivity (e.g., quasi-secular), so as to tailor the performance of the deflector 9 to the particular general lighting application. For other applications, it may also be desirable for the entire interior surface 9*s* of the deflector 9 to have a diffuse reflective characteristic. In such cases, the deflector 9 may be constructed using materials similar to those taught above for construction of the optical integrating cavity 2. In addition to reflectivity, the deflector may be implemented in different colors (e.g. silver, gold, red, etc.) along all or part of the reflective interior surface 9*s*.

In the illustrated example, the large distal opening of the deflector 9 is roughly the same size as the cavity 2. In some applications, this size relationship may be convenient for construction purposes. However, a direct relationship in size of the distal end of the deflector and the cavity is not required. The large end of the deflector may be larger or smaller than the cavity structure. As a practical matter, the size of the cavity is optimized to provide effective integration or combination of light from the desired number of LED type solid state sources 6. The size, angle and shape of the deflector 9 determine the area that will be illuminated by the combined or integrated light emitted from the cavity 2 via the aperture 5 and the liquid 7.

For convenience, the illustration shows, the lighting apparatus 1 emitting the light downward from the virtual source, that is to say downward through the aperture 5 and the liquid 7. However, the apparatus 1 may be oriented in any desired direction to perform a desired general lighting application function. Also, the optical integrating cavity 2 may have more than one optical aperture or passage, for example, oriented to allow emission of integrated light in two or more different directions or regions. The additional optical passage may be an opening or may be a partially transmissive or translucent region of a wall of the cavity.

Although not always required, in a typical implementation, a system incorporating the light fixture 1 also includes a controller. An example of a suitable controller and associated user interface elements is discussed in more detail later with regard to FIG. 15.

Figure 2:
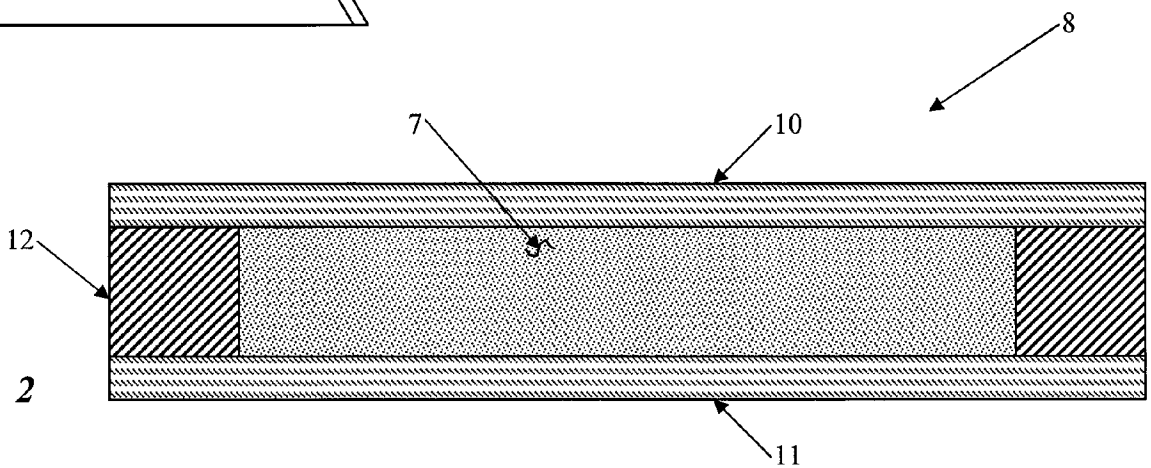
FIG. 2 is an enlarged cross sectional view of the liquid filled container used in the light fixture of FIG. 1.

Those skilled in the art will recognize that the container 8 for the quantum dot liquid 7 may be constructed in a variety of ways. FIG. 2 is a cross-sectional view of one example. As noted above, for simplicity, we have assumed that the aperture in the embodiment of FIG. 1 is circular. Hence, the container 8 would also be circular and sized to fit in the aperture 5. As shown in cross-section in FIG. 2, the container 8 includes two light transmissive elements 10 and 11, which may be transparent or translucent. The elements, for example, may be formed of a suitable glass or acrylic material. The elements 10 and 11 may be glued to or otherwise attached to a sealing ring 12. When so attached, the sealing ring provides an air tight and liquid tight seal for the volume between the elements 10 and 11. The liquid 7 substantially fills the volume of the container formed by the elements 10 and 11 and the sealing ring 12, preferably with little or no air entrained in the liquid 7. The height of the container 8 (vertical in the illustrated orientation of FIGS. 1 and 2) may be selected to provide an adequate volume for a desired amount of the liquid 7. The height of the container may be less than, equal to or greater than the height of the opening through the board 4 that forms the aperture 5.

The quantum dots contained in the liquid 7 will be selected to facilitate a particular lighting application for the apparatus 1. That is to say, for a given spectrum of light produced by the LEDs (L) 6 and the diffusely reflective cavity 2, the material and sizing of the quantum dots will be such as to shift at least some of the light emerging through the aperture 5 in a desired manner.

Quantum dots are often produced in solution. Near the final production stage, the quantum dots are contained in a liquid solvent. This liquid solution could be used as the quantum dot solution 7. However, the solvents tend to be rather volatile/flammable, and other liquids such as water may be used. The quantum dots may be contained in a dissolved state in solution, or the liquid and quantum dots may form an emulsion. The liquid itself may be transparent, or the liquid may have a scattering or diffusing effect of its own (caused by an additional scattering agent in the liquid or by the translucent nature of the particular liquid).

In the example of FIGS. 1 and 2, some light entering the container 8 through the upper element 10 will pass through the liquid 7 without interacting with any of the quantum dots. Other light from the cavity 2 will interact with the quantum dots. Light that interacts with the quantum dots will be absorbed by the dots and re-emitted by the dots at a different wavelength. Some of the light emitted from the quantum dots in the liquid 7 will be emitted back through the element 10 into the cavity 2, for diffuse reflection and integration with light from the LEDs (L) 6, for later emission through the aperture 6, the liquid 7 and the elements 10 and 11 of the container 8. Other light emitted from the quantum dots in the liquid 7 will be emitted through the element 11, that is to say together with the light that is passing through the liquid 7 without interacting with any of the quantum dots. In this way, light emerging from the fixture 1 via the aperture, container and liquid will include some integrated light from within the cavity 2 as well as some light shifted by interaction (absorption and re-emission) via the quantum dots contained in the liquid 7. Unless all of the LEDs are UV emitters (all pumping quantum dots), the spectrum of light emitted from the apparatus 1 thus includes at least some of the wavelengths of light from the LEDs (L) 6 as well as one or more wavelengths of the light shifted by the quantum dots. This combination of light provides the desired spectral characteristic of the fixture output, that is to say, for the intended general lighting application.

In the example of FIGS. 1 and 2, the container 8 took the form of a flat disk. However, the container may have a variety of other shapes. Just a few examples are shown in FIGS. 3A to 3H. Different shapes and/or textures may be chosen to facilitate a particular output distribution pattern and/or efficient extraction of integrated light from the cavity.

Figure 3A:
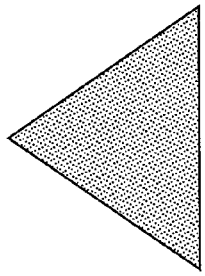
FIGS. 3A to 3H are cross sectional views showing several examples of alternative shapes of the liquid filled container, which may be used in place of the container in the fixture of FIG. 1.
Figure 3B:
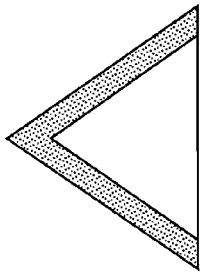
Figure 3C:
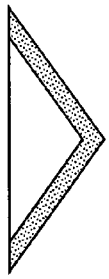

FIG. 3A is a cross-sectional view of a conical prism shape for the container. Although the narrow end of the prism could extend out from the cavity, assuming the orientations of FIGS. 1 to 3, the prism would extend from the aperture into the cavity. FIG. 3B shows a similar conical shape, however, the conical container of FIG. 3B is concave on the side adjacent to or in the aperture. FIG. 3C shows a conical shape similar to that of FIG. 3B but with the conical container extending in a direction that would project out of the cavity from the aperture. The concave portions of the containers of FIGS. 3B and 3C could be curved or could be conical, essentially following the larger conical shape of the opposite surface as shown.

Figure 3D:
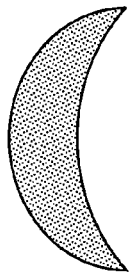

In FIG. 3D, the container cross-section approximates a quarter moon convex shape. Again, the container could extend from the aperture into the cavity or outward away from the cavity.

Figure 3E:
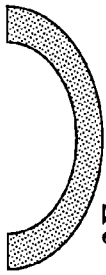
Figure 3F:
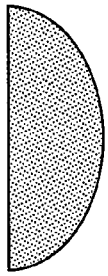

The outer surfaces of the containers illustrated in FIGS. 3E and 3F are somewhat convex and have an oval or elliptical convex shape. Again, the container in either example may extend from the aperture into the cavity or outward away from the cavity. FIG. 3E, depicts an example in which the surface adjacent to the cavity is concave, whereas FIG. 3F depicts an example in which the surface adjacent to the cavity is flat.

Figure 3G:
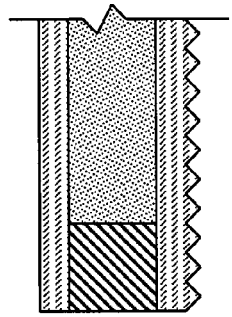

The surface at which the container 8 receives light from the cavity as well as the surface at which the light passes outward from the container may have a variety of different textures, selected to facilitate the particular lighting application. Textures(s) for one or both surfaces may be selected to improve light extraction from the cavity through the container, for example, to reduce total internal reflection at one or both container surfaces. FIG. 3G, for example, shows an example of a container in which the outer surface exhibits a rough texture. The rough texture may be somewhat regular, such as the triangular shaped pattern shown in this example, or the rough texture may be relatively irregular. The other surface of the container, in this case the surface at which the container receives light from the cavity, is smooth in the example of FIG. 3G. Of course, the roughened and smooth surfaces may be reversed.

Figure 3H:
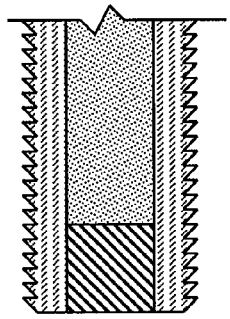

FIG. 3H depicts an example of the container in which both the light receiving surface and the light emergence surface exhibit a rough texture. The rough textures may be somewhat regular, such as the illustrated saw-tooth patterns shown in this example, or the rough textures may be relatively irregular. Similar or different rough textures may be used on the two surfaces.

The examples of FIGS. 3G and 3H assumed a flat disk shaped container, similar to the container of FIG. 2. Those skilled in the art will recognize that various smooth or roughened textures may be used at the surfaces of containers of other shapes, such as containers of the shapes illustrated in FIGS. 3A to 3F.

The roughening of the surface(s) in the examples of FIGS. 3G and 3H are shown as regular patterns. However, it is also possible to roughen or texture any surface in an irregular manner, for example by bead blasting or the like.

The examples shown and discussed so far (regarding FIGS. 1 to 3) have utilized a container for the liquid that effectively positions the liquid in the optical aperture to form a light transmissive passage for integrated light emerging as a uniform virtual source from the integrating cavity. Those skilled in the art will recognize that the liquid may be provided in the fixture in a variety of other ways and/or at other locations. It may be helpful to consider a few examples.

Figure 4:
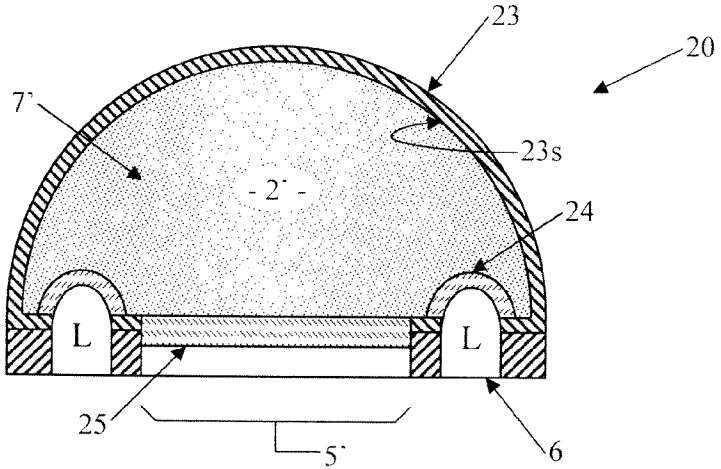
FIG. 4 is a cross section of another light fixture for a general lighting application, in which the optical integrating cavity is sealed to form the container for the liquid containing the quantum dots.

FIG. 4 therefore shows a fixture 20 in which the liquid 7' substantially fills the optical integrating cavity 2'. As in the example of FIG. 1, the lighting fixture or apparatus 20 has solid state light sources, again exemplified by a number of LEDs (L) 6. The fixture 20 also includes an optical integrating cavity that itself contains the liquid 7' containing the quantum dots.

In this example, the cavity 2' is formed by a material having a diffusely reflective interior surface or surfaces, in the shape of an integral member 23 forming both the dome and the plate. The material of the member 23 is chosen to provide a sealed liquid container, but the interior surface or surfaces of the member use materials similar to those described above in the discussion of FIG. 1 to provide the desired diffuse reflectivity on some or all of the internal surface(s) 23*s* with respect to light in the cavity 2'. Again, although a variety of shapes may be used, we will assume that the cavity 2' takes the shape of a hemisphere, for ease of illustration and discussion. Openings through the member 23 are sealed in an air tight and liquid tight manner. For example, openings for the LEDs (L) 6 may be sealed by covering the LEDs with an optical adhesive or similar light transmissive sealant material as shown at 24, which protects the LEDs from the liquid 7' and seals the spaces between the LEDs and the surrounding structure of the member 23.

The member 23 in this example also has an aperture 5' through which integrated light emerges from the cavity 2'. One or more additional optical processing elements may be coupled to the aperture, such as the deflector discussed above relative to the example of FIG. 1. However, in this example, the aperture 5' provides the uniform virtual source and the output of the light fixture 20. To contain the liquid 7, this aperture 5' is sealed with a light transmissive plug 25, formed of a suitable plastic or glass. The plug may be pressed into the aperture, but typically, a glue or other sealant is used around the edges of the plug 25 to prevent air or liquid leakage. The light transmissive plug 25 in the aperture 5' may be transparent, or it may be translucent so as to provide additional light diffusion.

Again, each LED (L) 6 is coupled to supply light to enter the cavity 2' at a point that directs the light toward a reflective surface 23' so that it reflects one or more times inside the cavity 2', and at least one such reflection is a diffuse reflection. As the light from the LEDs (L) 6 passes one or more times through the volume of the cavity 2', the light also passes one or more times through the liquid 7'. As in the earlier example, the liquid contains quantum dots. Some light interacts with the quantum dots to produce a shift. Some of the shifted light passes directly through the aperture 5', and some of the shifted light reflects off the reflective surface(s) 23 of the cavity 2'. The cavity 2' acts as an optical integrating cavity to produce optically integrated light of a uniform character forming a uniform virtual source at the aperture 5'. The integrated light output includes some light from the sources 6 as well as some of the light shifted by the quantum dots of the liquid 7'. The output exhibits similar uniform virtual source characteristics to the light at the aperture in the example of FIG. 1; but in the example of FIG. 4, the integration of the shifted light is completed within the cavity 2' before passage through the optical aperture 5.

Figure 5:
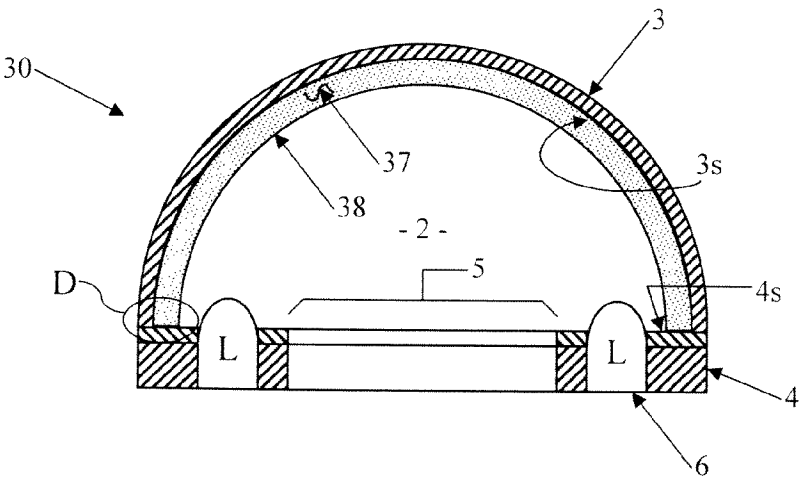
FIG. 5 is a cross section of another light fixture for a general lighting application, including a container configured to position the liquid containing the quantum dots adjacent to the diffusely reflective interior surface of the optical integrating cavity.

FIG. 5 depicts another light fixture 30 for a general lighting application, including a container 28 configured to position the liquid 27 containing the quantum dots adjacent to the diffusely reflective interior surface 3*s* of the optical integrating cavity 2. In general, the elements, arrangement and operation of the light fixture 30 are similar to those of the fixture of FIG. 1, and like elements are indicated by the same reference numerals. For convenience, detailed discussion of the similar elements is omitted here, although the reader may wish to reconsider portions of the description of FIG. 1. In this example, the aperture 5 provides the uniform virtual source and final output of integrated light of the fixture 30.

In the example of FIG. 5, the quantum dot liquid 37 is adjacent to and conforms to the contour of at least a substantial portion of the reflective surface 3*s* of the dome 3 of the integrating cavity 2. For that purpose, the lighting apparatus includes a hemispherical container 38, the outer surface of which at least substantially conforms to the contour of the inner surface 3*s* of the dome 3. The container 38 may be formed of glass or plastic members and a sealing ring, as shown in detail in FIGS. 5D-1 to 5D-2, in a manner analogous to the container structure discussed above relative to FIG. 2. However, rather than a flat disk shape for positioning in the circular aperture, as in the example of FIGS. 1 and 2, the container 38 is shaped for positioning adjacent to the reflective surface 3*s*.

Again, each LED (L) 6 is coupled to supply light to enter the cavity 2 at a point that directs the light toward a reflective surface 3*s* of the cavity 2. However, in this example, the light impacts on the inner surface of the quantum dot liquid container 38. As noted earlier, one or both of the transmissive elements of the container may be transparent or translucent and as a result may produce some reflection. However, a substantial portion of the light passes into the container 38. Within the container 38, some light interacts with the quantum dots to produce a color shift, as discussed above. Some shifted light reflects off the surface 3*s* and passes back through the container 38 and the liquid 37. However, some light from the sources passes through the container and liquid without a quantum dot shift and is diffusely reflected back by the surface 3*s*. As it passes back through the container and liquid, additional light may interact with the quantum dots, and some of the diffusely reflected light emerges from the container back into the open volume portion of the cavity 2 together with the light shifted by interaction with the quantum dots in the liquid 37.

As outlined above, the integrating cavity diffusely reflects light from the LEDs (L) 6, and the quantum dots liquid 37 produces shifted light, much like in the earlier examples. The processing within the cavity 2 will integrate the light for emission through the aperture 5. The integrated light output includes some light from the sources 6 as well as some of the light shifted by the quantum dots of the liquid 37. The output at the aperture 5 exhibits uniform virtual source characteristics as discussed above relative to the earlier examples of FIGS. 1 and 4.

Figures 2, 5D:
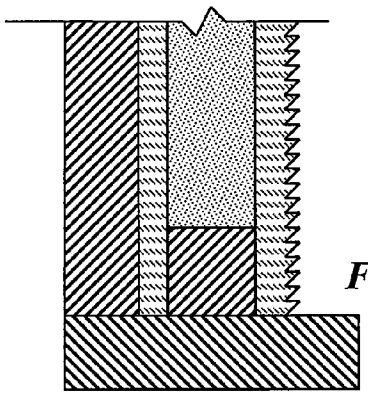
Figures 4, 5D:
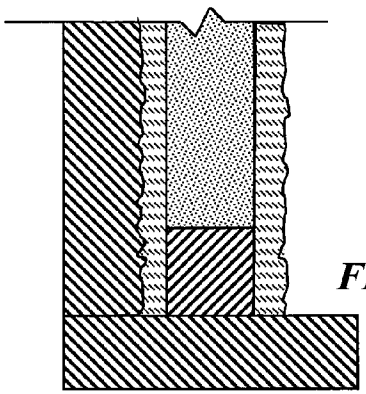
Figures 1, 5D:
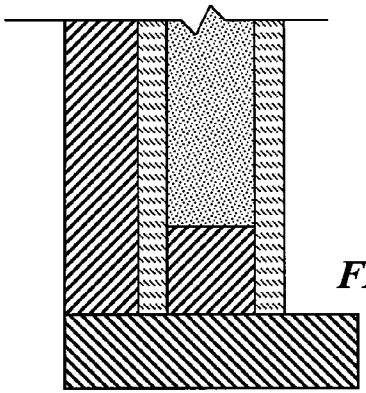

FIGS. 5D-1 to 5D-4 are enlarged cross sectional detail (D) views of a portion of the fixture of FIG. 5, at the location indicated by the oval D in FIG. 5. As shown in these detail views and FIG. 5, the container includes two light transmissive elements, which in the hemispherical example would take the shape of two concentric hemispheres. These hemispherical elements may be transparent or translucent. The elements, for example, may be formed of a suitable glass or acrylic material. The elements may be glued to or otherwise attached to a sealing ring. When so attached, the sealing ring provides an air tight and liquid tight seal for the volume between the concentric elements. The liquid substantially fills the volume of the container formed by the elements and the sealing ring, preferably with little or no air entrained in the liquid 37.

FIGS. 5D-1 to 5D-4 show different textures at surfaces of several components of the fixture for several different examples. As shown in FIG. 5D-1, the light transmissive members of the container provide smooth inner and outer surfaces. The smooth inner surface closely conforms to the smooth inner surface of the reflective inner surface of the dome. However, it is also contemplated that one or both surfaces may have a non-smooth or roughened texture. The rough textured surface finishes provide additional diffusion.

Figures 3, 5D:
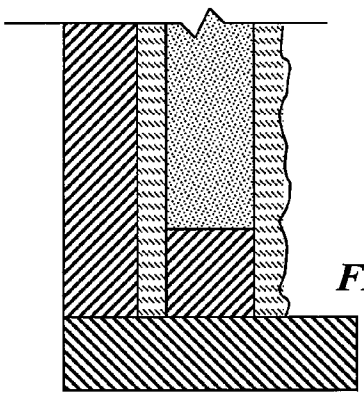

In FIG. 5D-2, the inner surface of the container is roughened. In that example, the roughening is shown as a regular pattern such as a saw tooth pattern, although other regular patterns may be provided by appropriate processing of the surface. FIG. 5D-3 shows a similar example with a roughened internal surface, but with an irregular contour or texture. Such a roughening of the surface may be provided by bead blasting or the like.

FIG. 5D-4 shows an example in which the outer surface of the container is textured. The inner surface of the container may be flat or regularly textured as in the examples of FIGS. 5D-1 and 5D-2, respectively, but in the 5D-4 example, the inner surface has an irregular texture. The inner surface of the dome would be textured, and the outer surface of the container would have a substantially similar texture, in the illustration an irregular roughened texture although a more regular pattern could be provided. The example of FIG. 5D-4 could be produced by bead blasting the inner and outer surfaces of the container and then forming the dome 3 as a diffusely reflective coating layer on the outer surface of the container.

Figure 6:
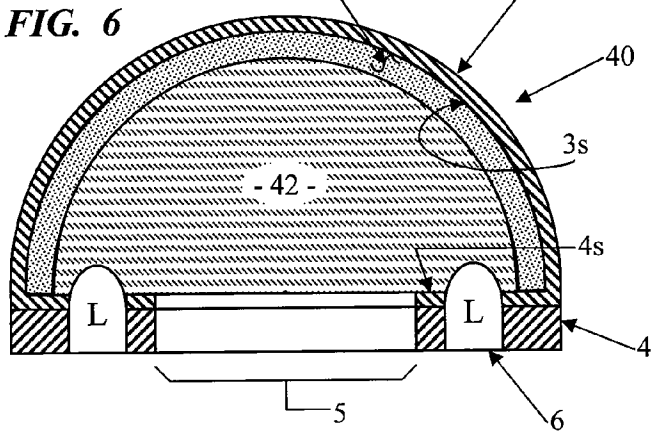
FIG. 6 is a cross section of another light fixture for a general lighting application, wherein a light transmissive solid material fills a substantial portion of the interior volume of the cavity, so as to form a container volume for the liquid containing the quantum dots, between the solid and the interior surface of the cavity.

FIG. 6 is a cross section of another light fixture 40 for a general lighting application. Generally, the fixture 40 is similar to the fixture of FIG. 1 (without the deflector) and may use similar materials/components for the various common elements. Hence, like in the earlier example, the lighting fixture or apparatus 40 has LED (L) type solid state light sources 6, a chamber formed by reflective surfaces 3*s*, 4*s* of a dome 3 and plate 4. At least some of the reflective surface area of the surfaces 3*s*, 4*s* is highly diffusely reflective as discussed above, so that the chamber functions as an optical integrating cavity. In the example of FIG. 6, however, a light transmissive solid material 42 fills a substantial portion of the interior volume of the chamber. A container for the liquid 47 containing the quantum dots is formed between the transmissive solid 42 and the interior surfaces 3*s*, 4*s* that form the optical integrating cavity type chamber.

The fixture 40 will operate in a manner somewhat analogous to the fixture of FIG. 4 to produce a uniform virtual source output of integrated light from the sources and re-missions of light from the quantum dots. However, the transmissive solid material 42 may have an index of reflection higher than that of air, to reduce total internal reflection that may occur at the interface of the container of FIG. 4 with air within the open volume of the cavity in the implementation of FIG. 4.

Figure 7:
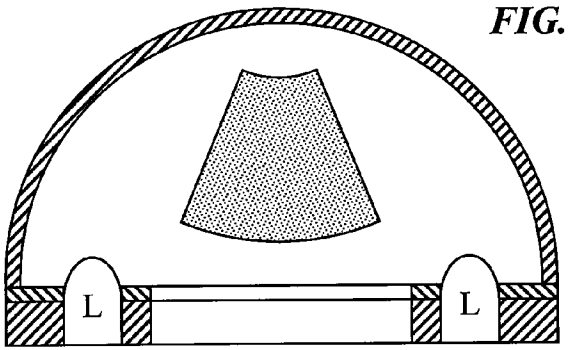
FIG. 7 is a cross section of another light fixture for a general lighting application, in which a vial of an arbitrary shape, containing the quantum dots liquid, is suspended within the volume of the cavity.
Figure 8:
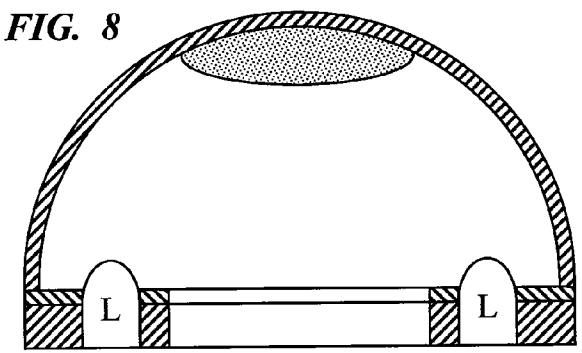
FIG. 8 is a cross section of another light fixture for a general lighting application, in which a container of an arbitrary shape, containing the quantum dots liquid, is positioned on a portion of the interior surface of the cavity.
Figure 9:
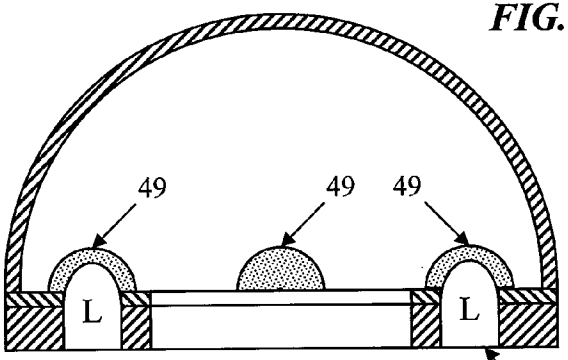
FIG. 9 is a cross section of another light fixture for a general lighting application, in which a number of quantum dots liquid containers are positioned on the board or plate so as to be interspersed among the LED type solid state light emitters.

The present teachings also encompass a variety of other locations, structures or arrangements of one or more containers for the quantum dot liquid within a fixture otherwise similar to those discussed so far relative to FIGS. 1-6. FIGS. 7-9 show similarly constructed lighting fixtures but with different liquid containers. FIG. 7 depicts a fixture in which a vial of an arbitrary shape, containing the quantum dot liquid, is suspended within the volume of the optical integrating cavity. FIG. 8 shows a light fixture in which a container of an arbitrary shape, containing the quantum dots liquid, is positioned on a portion of the interior surface of the cavity. FIG. 9 illustrates a light fixture in which a number of containers 49 of the quantum dot liquid are positioned on the board or plate so as to be interspersed among the LED (L) type solid state light emitters 6. In each of these various cases, the optical integrating cavity integrates light from the LEDs (L) and light shifted by the quantum dots to form a uniform virtual source output at the aperture or other transmissive optical passage out of the cavity.

To tailor the output distribution from the light fixture to a particular general lighting application, it is also possible to construct the optical cavity so as to provide constructive occlusion. Constructive occlusion type lighting systems utilize a light source optically coupled to an active area of the fixture, typically the aperture of a cavity or an effective aperture formed by a reflection of the cavity. This type of fixture utilizes diffusely reflective surfaces, such that the active area exhibits a substantially Lambertian characteristic. A mask occludes a portion of the active area of the fixture, in the following examples, the aperture of the cavity or the effective aperture formed by the cavity reflection, in such a manner as to achieve a desired output performance characteristic for the lighting apparatus with respect to the area or region to be illuminated for the lighting application. In examples of the present fixtures or systems using constructive occlusion, the optical integrating cavity comprises a base, a mask and a cavity formed in the base or the mask. The mask would have a reflective surface facing toward the aperture. The mask is sized and positioned relative to the active area so as to constructively occlude the active area. As with the earlier optics, the constructive occlusion type fixture would also include a liquid containing quantum dots. It may be helpful to consider some examples of fixtures using constructive occlusion.

Figure 11:
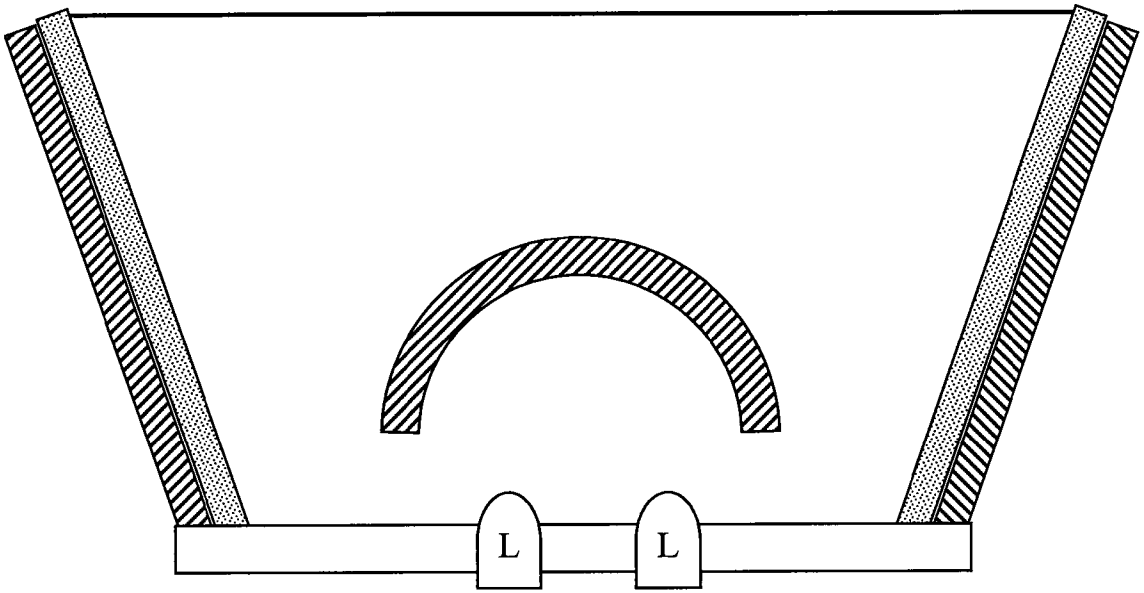
FIG. 11 is a cross section of another constructive occlusion example of a light fixture for a general lighting application, including a container configured to position the liquid containing the quantum dots adjacent to the reflective surface of an additional optical processing element, which in this example is a deflector or concentrator coupled to the active optical surface of the mask and cavity of the constructive occlusion optic.
Figure 10:
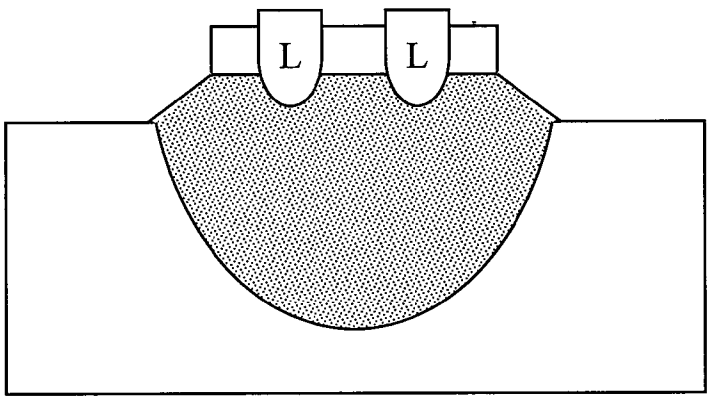
FIG. 10 is a cross section of another light fixture for a general lighting application, which utilizes a mask in combination with the cavity, configured to implement constructive occlusion, in which the volume between the constructive occlusion mask and the surface of the cavity is sealed to form the container for the liquid containing the quantum dots.

FIG. 10 shows a general lighting fixture, which utilizes a mask in combination with a cavity, configured to implement constructive occlusion, in which the volume between the mask and the surface of the cavity is sealed to form the container for the liquid containing the quantum dots. FIG. 11 illustrates another constructive occlusion example of a light fixture for a general lighting application, including a container configured to position the liquid containing the quantum dots adjacent to the reflective surface of an additional optical processing element, which in this example is a conical deflector or concentrator coupled to the active optical surface of the mask and cavity constructive occlusion optic. More detailed discussions of the light generation, diffuse reflection and constructive occlusion operations of similar light fixtures may be found in previously incorporated US Patent Application Publication No. 2007/0045524 (with respect to FIGS. 11-16 thereof) and the discussion of those similar examples from that Publication are incorporated herein by reference.

Of note for purposes of this discussion, in the example of present FIG. 10, the volume between the wall of the cavity and the facing surface of the mask is substantially filled by a container. The container in turn contains quantum dot liquid, like the liquids in the earlier examples. In this way, the light emissions from the fixture of FIG. 10 will include some light from the LEDs (L) and some shifted light from the quantum dots in the liquid, much like in the earlier examples. However, the constructive occlusion provides a tailored intensity distribution of the light output, over the field of intended illumination.

In the example of FIG. 11, the constructive occlusion cavity is formed in the mask, and the base is flat. The fixture also includes a deflector coupled to the active optical area of the base. In this example, a liquid container is positioned along the reflective surface of the deflector, which contains quantum dots. The container may be constructed in a manner discussed above, e.g. relative to FIGS. 5D-1 to 5D-4, but will generally conform in shape to the reflective inner surface of the deflector. The quantum dots in the liquid in the container shift of the light output, essentially as did the quantum dots in earlier examples, such as in the example of FIG. 1. Hence, the light output of the fixture again includes some light from the LEDs (L) and some shifted light from the quantum dots in the liquid, however, the constructive occlusion provides a tailored intensity distribution of the light output, over the field of intended illumination defined by the deflector.

Figure 12:
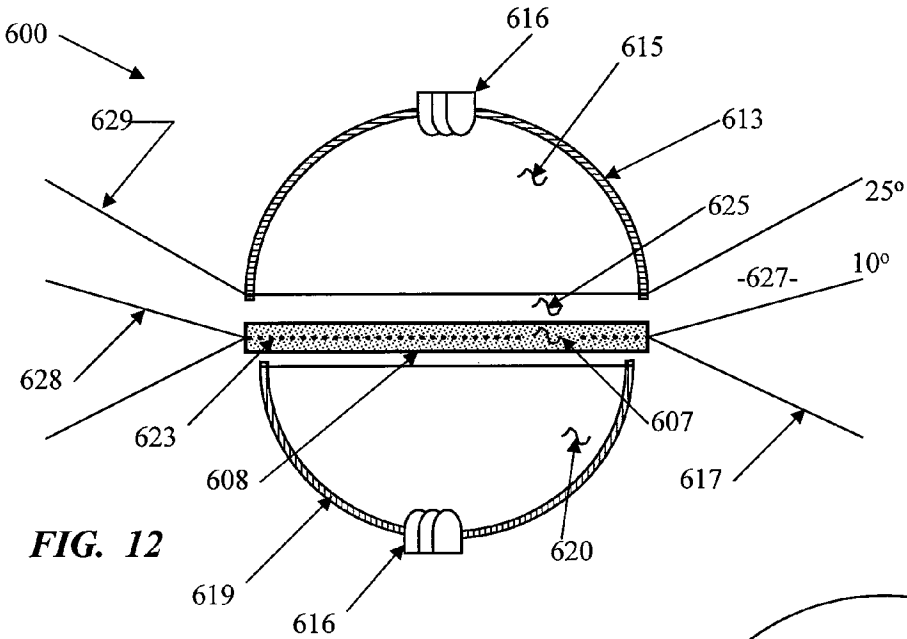
FIG. 12 is a cross section of yet a further constructive occlusion example of a light fixture for a general lighting application, having a ported cavity and a fan shaped deflector, with a container of quantum dots liquid located at the constructively occluded aperture of the optic.
Figure 13:
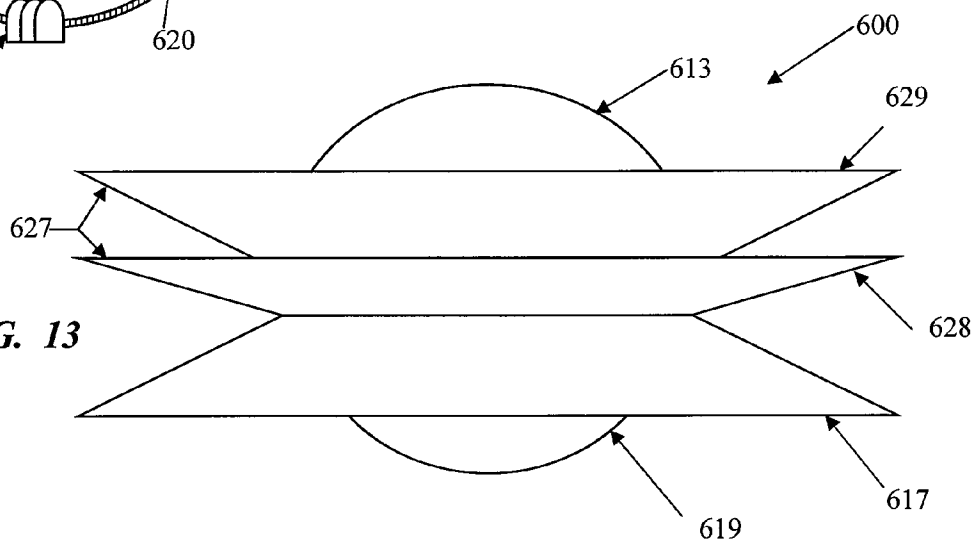
FIG. 13 is a side or elevational view.
Figure 14:
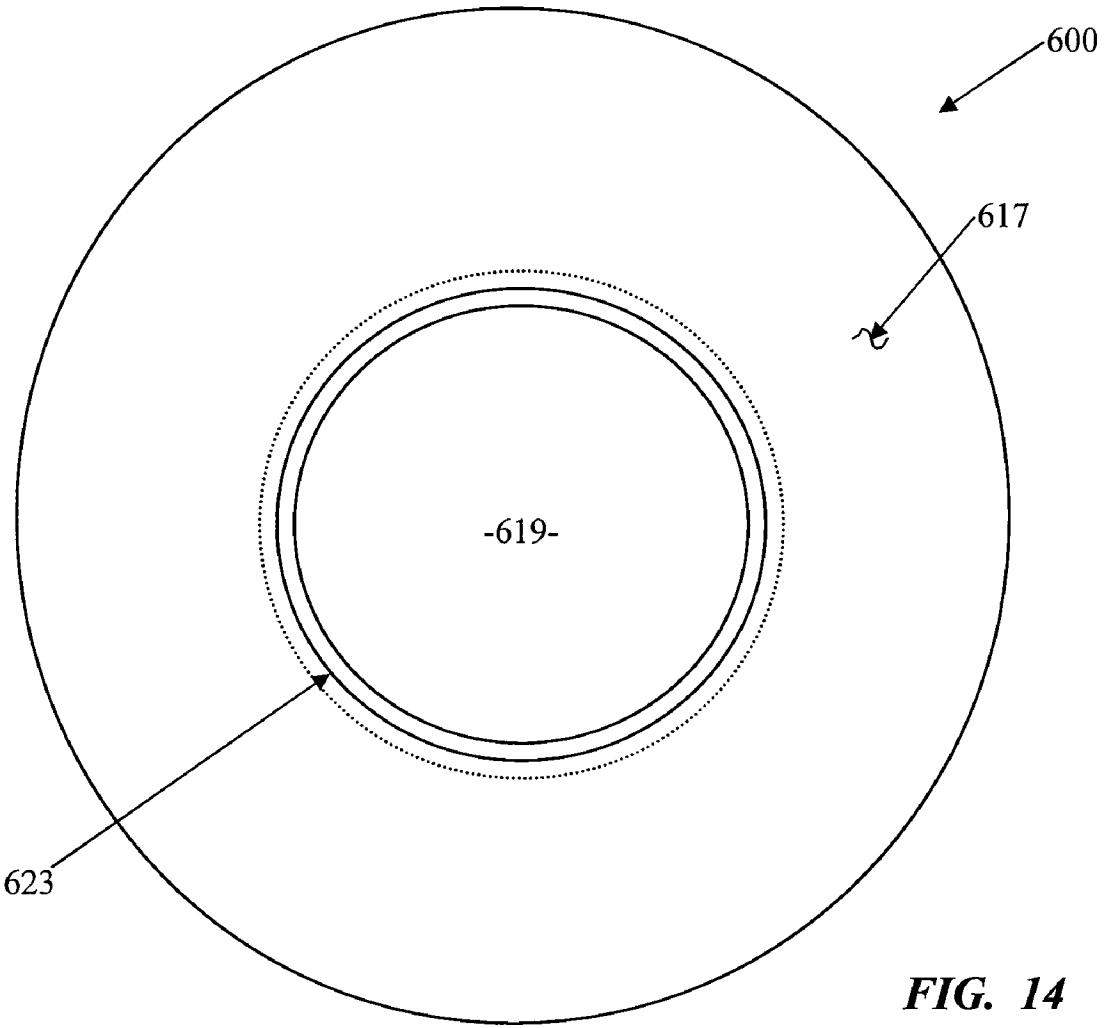
FIG. 14 is a bottom plan view, of the light fixture of FIG. 12.

FIG. 12 illustrates yet a further constructive occlusion example of a light fixture for a general lighting application. FIG. 13 is a side or elevational view, and FIG. 14 is a bottom plan view, of the light fixture of FIG. 12. In that example, the fixture 600 has a ported cavity and a fan shaped deflector, with a container 608 of the quantum dots liquid 607 located at the constructively occluded aperture 623 of the optic. The liquid 607 and container 608 may be similar to those discussed above relative to FIGS. 1-3, where the container was inserted or mounted in the aperture. In general, an optic like that shown in FIGS. 12-13 uses an optical integrating cavity to supply light energy through a port to a deflector. The port serves as an optical aperture for emission of integrated light. The deflector coupled to the port may form a "fan" extending along one side or around all or part of the circumference of the cavity. The deflector also expands (up and down in the illustration) as it extends out from the port. Principles of constructive occlusion (diffuse reflectivity in a mask and cavity structure) are combined with the port and deflector structure. The cavity and mask serve as the optical integrating cavity. The constructive occlusion provides a tailored intensity distribution for light energy illuminating a first region; whereas the integrating cavity, port and deflector distribute another portion of the light energy over a second field of intended illumination. The first and second areas illuminated may overlap slightly, or one may include the other, but preferably most of the two areas are separate. In some cases such as the example of FIGS. 12-14, the fixture configuration creates a dead zone between the two regions. Light emitted by the system includes light from the LED (L) type solid state light sources as well as light shifted by quantum dots in a liquid, essentially as in earlier examples. A more detailed discussion of such ported cavity and fan type optics utilizing constructive occlusion may be found in AOT's U.S. Pat. No. 6,286,979, the entire disclosure of which is incorporated herein by reference.

In view of the addition of the port, it may be helpful to consider this constructive occlusion example in somewhat more detail. The fixture 600 comprises two opposing domes 613 and 619 of slightly different diameters supported at a distance from each other. Although other shapes may be used, in the example, each dome is substantially hemispherical. The inner surfaces of the domes 613, 619 are diffusely reflective, as in several of the earlier examples. The upper dome 613 forms the base for constructive occlusion purposes and is slightly larger in horizontal diameter than the lower dome 619. The lower dome 619 forms the mask for constructive occlusion purposes. The inner surface of the upper dome 613 forms a reflective cavity 615 in the shape of a segment of a sphere. The reflective interior 620 of the lower dome 619 could be considered as a cavity (similar to cavity 615 as well as various cavities in the earlier examples), but for purposes of discussion here we will refer to the reflective interior region 620.

Although other lamps or light sources could be used, for discussion purposes, the fixture is assumed to use one or more LED type solid state light sources similar to those used in the earlier examples. Hence, as shown in FIG. 12, the fixture includes a number of LEDs 616 coupled to the domes 613 and 619 so as to supply light into the volume between the reflective domes. As in earlier examples, the LEDs may be located at or coupled to various points on the diffusely reflective cavity or volume between the domes; and light from LEDs may be oriented or directed from the LEDs in various directions toward any of the reflective interior surfaces of the fixture.

Although other shapes may be used, in the example, the mask 619 takes the form of a second dome forming the reflective region 620. The fixture 600 may use the dome-shaped mask, a smaller dome or even a flat disk-shaped mask, if the designer elects. The combination of the cavity 615 and the hemispherical reflector region 620, within the domes, closely approximates a spherical optical integrating cavity.

Although the liquid 607 may be provided in a number of different ways, in this example, a container 608 of quantum dot liquid 607 is mounted in the aperture 623. As emitted and reflected light passes through the aperture 623 it passes through the liquid 607 and some light interacts with the quantum dots in the liquid. Hence, light emerging from the aperture will include some light from the LEDs (L) 616 as well as some light shifted by the absorption and re-emission by quantum dots in the liquid 607.

The fixture 600 also comprises three angled, circular plates 617, 628 and 629 mounted to encircle the two domes 613, 619 as shown. Each angled plate takes the form of a truncated, straight-sided cone. The cone formed by the lower plate 617 has its broad end down in the orientation shown in FIGS. 12 and 13. The cone of the plate 628 has its broad end upward as does the cone of the plate 629. In the example, the sidewall of the cone of the plate 628 has a 10° incline (up from the horizontal in the illustrated orientation); and the sidewall of the cone of the plate 629 has a 25° angle inclination upward relative to the illustrated horizontal.

The lower or inner surface of the plate 617 is reflective and serves as a shoulder formed about the constructive occlusion aperture 623 of the fixture 600. The upper or inner surface of the plate 628 is reflective and serves as one wall of the expanding fan-shaped deflector 627. The lower or inner surface of the plate 629 is reflective and serves as the other wall of the expanding fan-shaped deflector 627. The reflective shoulder surface of the plate 617 preferably is specular, although materials providing a diffuse reflectivity or other type of reflectivity could be used on that surface. At least a substantial portion of each of the reflective surfaces of the deflector 627 has a specular reflectivity. Some sections of those surfaces may have a different reflectivity, such as a diffuse reflectivity, for example, adjacent the outer ends of the surfaces, for certain applications.

The junction between the plates 617 and 628 forms the aperture 623. The space between that boundary and the lower edge of the plate 629 forms an annular port 625 formed in the wall of the base 613 to provide the optical coupling of the cavity 615 to the deflector 627. Although referred to as a "port" herein to distinguish from the constructive occlusion aperture, the port 625 does form another optical passage for emission of integrated light from the volume within the domes. In this embodiment, annular port 625 is adjacent to the aperture 623. This position for the port may be preferred, for ease of construction, but the annular port could be at any elevation on the dome forming the base 613 and cavity 615, to facilitate illumination of a second field or region at a particular angular range relative to the light fixture 600 with integrated light from the cavity 615.

In this example, the port 625 is formed along the boundary between the edge of the cavity 615 and the shoulder 617. Consequently, the inner edge of the shoulder 617 actually defines the aperture 623 for constructive occlusion purposes with respect to the first region intended for illumination by the fixture 600. The aperture 623 is said to be the aperture of the base-cavity 615 and define the active optical area of the base 613 essentially as if the sides of the cavity 615 extended to the edges of the shoulder 617 (without the port).

Hence the cavity 615, the aperture 623, the mask 619 and the shoulder 617 provide constructive occlusion processing of a first portion of the light from the LEDs 616 and from the quantum dots in the liquid 607. The light emitted as a result of such processing provides a tailored intensity distribution for illumination of a first region, which is below the fixture 600 in the orientation shown in FIGS. 12 and 13. The relative dimensions of the aperture and mask, the distance of the mask from the aperture and size and angle of shoulder 617 determine the intensity distribution in this region, as discussed in the U.S. Pat. No. 6,286,979 Patent.

With respect to the port 625, the diffusely reflective surfaces 615 and 620 inside the two domes 613 and 619 together approximate an optically integrating sphere. The integrating sphere processes light from the LEDs 616 as well as at least some light shifted by the quantum dots in the liquid 607 and provides an efficient coupling of some of that light through the port 625. As with light emitted through the aperture 623, light emitted through the port 625 and deflector 627 includes some light from the sources 616 as well as some shifted light from the quantum dots in the liquid 607.

The fan-shaped deflector 627 directs light emerging through the port 625 upward, away from the first (downward) field of intended illumination. In the illustrated example, the plates 628 and 629 form a limited second field of view, for angles roughly between 10° and 25° above the horizontal in this example. When measured with respect to the downward illumination axis of the fixture 600 as is used in lighting industry standards, this second field of illumination encompasses angles between 100° and 115°. Although some light passing through the port 625 is still directed outside the field of view defined by the deflector walls 628, 629, the reflective surfaces of the deflector 627 do channel most of the light from the port 625 into the area between the angles formed by those walls. As a result, the maximum intensity in the second illuminated region is between the angles defining the field of view of the deflector 627.

In this example, the fan-shaped deflector structure is angled so as to direct light away from the field illuminated by constructive occlusion. The two illuminated regions do not overlap at all. The plates 617 and 628 create a dead zone of no illumination between the two regions.

In an under canopy type lighting application, for example, the fixture 600 is mounted or hung under a canopy. The mounting may place the upper edge of the upper angled plate 629 of the deflector 627 at the surface of the underside of the canopy or a few inches below that surface. The apparatus 611 emits approximately 60% of the light energy output upward, via the port 625 and the fan-shaped deflector structure 627. The fixture 611 emits approximately 40% of the light output downward, as processed by constructive occlusion. The emissions upward are separated from the downward emissions by a dead zone around the horizontal in the orientation illustrated in FIGS. 12 and 13. The dead zone prevents direct illumination of adjacent areas, for example on a nearby highway or in a house next-door to a gas station that has the canopy and the under-canopy light fixture.

Because of the structure of the fixture 600, the light that otherwise would emerge undesirably in the dead zone is kept within the optic and reprocessed by the reflective surfaces, until it emerges into one or the other of the two desired fields of illumination. The fixture 600 therefore provides the desired lighting performance with a particularly high degree of efficiency.

The lighting fixture structure illustrated in FIGS. 12-14 is round and symmetrical about a vertical system axis. For other applications, the design could be made rectangular or even linearized.

A system will typically include a lighting apparatus in the form of a fixture including one or more light sources, and optical integrating cavity and possibly one or more further optical processing elements represented by way of example as a deflector in several of the earlier examples. As discussed herein, the fixture includes or contains a quantum dot liquid. At least in the examples discussed above using solid state light sources, the system also would include electronic circuitry to drive and/or control operation of the solid state light sources and thus to operate the light of the fixture. Those skilled in the art will be familiar with a variety of different types of circuits that may be used to drive the solid state light sources. However, it may be helpful to some readers to consider a specific example is some detail.

Figure 15:
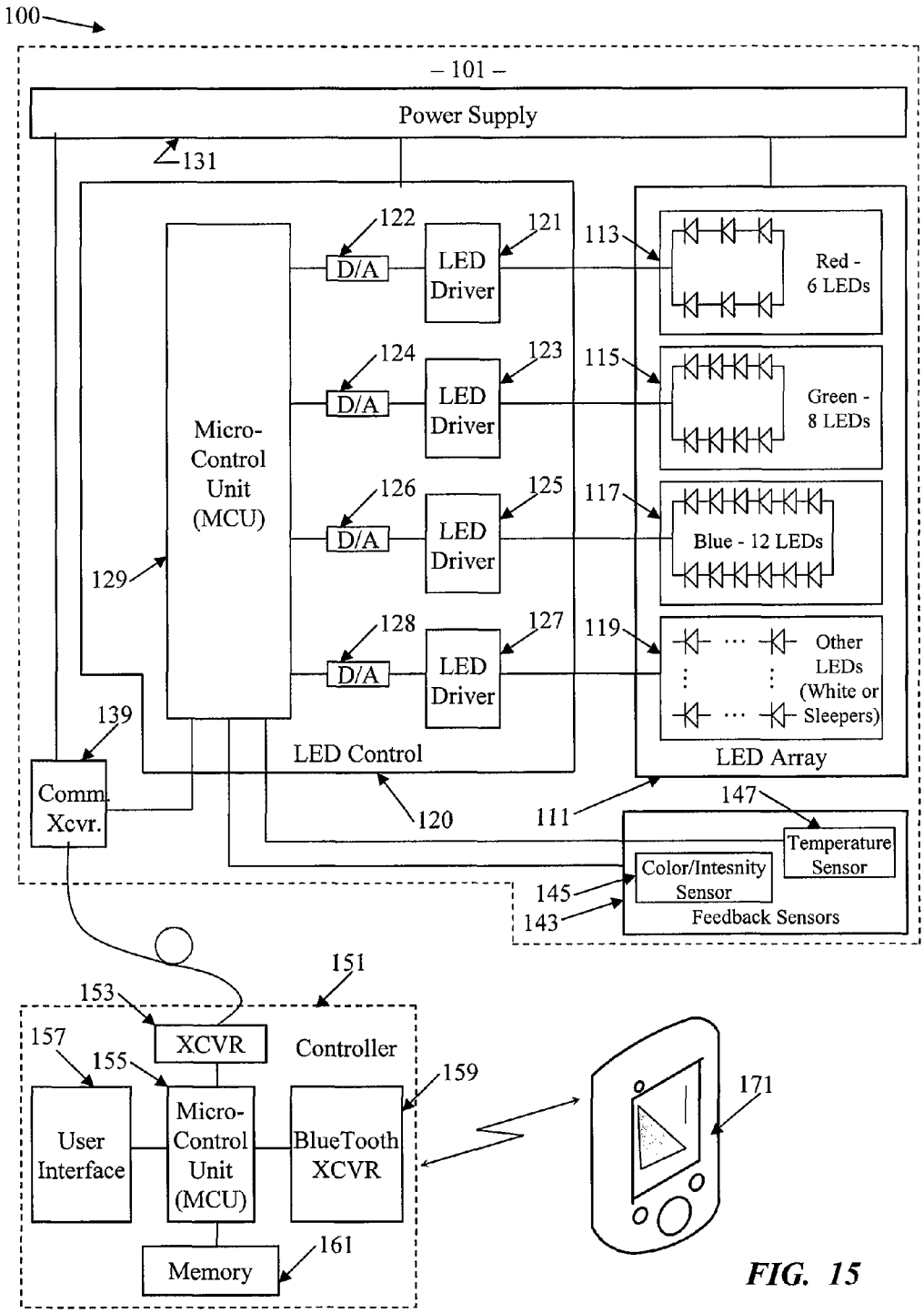
FIG. 15 is a functional block diagram of electronics that may be used in any LED type implementation of any of the fixtures, to produce the desired illumination for the general lighting application.

FIG. 15 is a block diagram of an exemplary solid state lighting system 100, including the control circuitry and the LED type sold state light sources utilized as a light engine 101 in the fixture or lighting apparatus of such a system. Those skilled in the art will recognize that the system 100 may include a number of the solid state light engines 101. The light engine(s) 101 could be incorporated into the fixture in any of the examples discussed so far relative to FIGS. 1-14.

The circuitry of FIG. 15 provides digital programmable control of the light. Those skilled in the art will recognize that simpler electronics may be used for some fixture configurations, for example, an all white LED fixture may have only a simple power supply.

In the light engine 101 of FIG. 15, the set of solid state sources of light takes the form of a LED array 111. Although other combinations of two or more color LEDs are within the scope of the present teachings, for purposes of discussion of the exemplary circuitry, we will assume that the array includes at least three primary color LED type solid state sources. Hence, the exemplary array 111 comprises two or more LEDs of each of three primary colors red (R), green (G) and blue (B), represented by LED blocks 113, 115 and 117, respectively. For example, the array 111 may comprise six Red LEDs 113, eight Green LEDs 115 and twelve Blue LEDs 117, although other primary colors may be used (e.g., cyan, magenta and yellow).

The LED array 111 in this example also includes a number of additional or "other" LEDs 119. There are several types of additional LEDs that are of particular interest in the present discussion. One type of additional LED provides one or more additional wavelengths of radiant energy for integration within the chamber. The additional wavelengths may be in the visible portion of the light spectrum, to allow a greater degree of color adjustment of the virtual source light output. Alternatively, the additional wavelength LEDs may provide energy in one or more wavelengths outside the visible spectrum, for example, in the infrared (IR) range or the ultraviolet (UV) range. UV light, for example, may be used to pump certain types/sizes of quantum dots in a liquid.

The second type of additional LED that may be included in the system 100 is a sleeper LED. Some LEDs initially would be active, whereas the sleepers would be inactive, at least during initial operation. Using the circuitry of FIG. 15 as an example, the Red LEDs 113, Green LEDs 115 and Blue LEDs 117 might normally be active. The LEDs 119 would be sleeper LEDs, typically including one or more LEDs of each color used in the particular system, which can be activated on an "as-needed" basis, e.g. to compensate for declining performance of corresponding color LEDs 113, 115 or 117.

The third type of other LED of interest is a white LED. The entire array 111 may consist of white LEDs of one, two or more color temperatures. There may be a combination of white LEDs and LEDs of one single wavelength chosen to correct the color temperature of the light form the white LEDs, e.g. yellow or red LEDs or UV LEDs to pump reddish quantum dots to compensate for the somewhat bluish temperature of most types of white LEDs. For white lighting applications using primary color LEDs (e.g. RGB LEDs as shown), one or more additional white LEDs provide increased intensity; and the primary color LEDs then provide light for color adjustment and/or correction.

The electrical components shown in FIG. 15 also include an LED control system 120 as part of the light engine 101. The system 120 includes driver circuits 121 to 127 for the various LEDs 113 to 119, associated digital to analog (D/A) converters 122 to 128 and a programmable micro-control unit (MCU) 129. The driver circuits 121 to 127 supply electrical current to the respective LEDs 113 to 119 to cause the LEDs to emit visible light or other light energy (e.g. IR or UV). Each of the driver circuits may be implemented by a switched power regulator (e.g. a Buck converter), where the regulated output is controlled by the appropriate signal from a respective D/A converter. The driver circuit 121 drives the Red LEDs 113, the driver circuit 123 drives the Green LEDs 115, and the driver circuit 125 drives the Blue LEDs 117. In a similar fashion, when active, the driver circuit 127 provides electrical current to the other LEDs 119. If the other LEDs provide another color of light, and are connected in series, there may be a single driver circuit 127. If the LEDs are sleepers, it may be desirable to provide a separate driver circuit 127 for each of the LEDs 119 or at least for each set of LEDs of a different color.

The driver circuits supply electrical current at the respective levels for the individual sets of LEDs 113-119 to cause the LEDs to emit light. The MCU 129 controls the LED driver circuit 121 via the D/A converter 122, and the MCU 129 controls the LED driver circuit 123 via the D/A converter 124. Similarly, the MCU 129 controls the LED driver circuit 125 via the D/A converter 126. The amount of the emitted light of a given LED set is related to the level of current supplied by the respective driver circuit, as set by the MCU 129 through the respective D/A converter.

In a similar fashion, the MCU 129 controls the LED driver circuit 127 via the D/A converter 128. When active, the driver circuit 127 provides electrical current to the other LEDs 119. If the LEDs are sleepers, it may be desirable to provide a separate driver circuit and A/D converter pair, for each of the LEDs 119 or for other sets of LEDs of the individual primary colors.

In operation, one of the D/A converters receives a command for a particular level, from the MCU 129. In response, the converter generates a corresponding analog control signal, which causes the associated LED driver circuit to generate a corresponding power level to drive the particular string of LEDs. The LEDs of the string in turn output light of a corresponding intensity. The D/A converter will continue to output the particular analog level, to set the LED intensity in accord with the last command from the MCU 129, until the MCU 129 issues a new command to the particular D/A converter.

The control circuit could modulate outputs of the LEDs by modulating the respective drive signals. In the example, the intensity of the emitted light of a given LED is proportional to the level of current supplied by the respective driver circuit. The current output of each driver circuit is controlled by the higher level logic of the system. In this digital control example, that logic is implemented by the programmable MCU 129, although those skilled in the art will recognize that the logic could take other forms, such as discrete logic components, an application specific integrated circuit (ASIC), etc.

The LED driver circuits and the MCU 129 receive power from a power supply 131, which is connected to an appropriate power source (not separately shown). For most general lighting applications, the power source will be an AC line current source, however, some applications may utilize DC power from a battery or the like. The power supply 131 converts the voltage and current from the source to the levels needed by the driver circuits 121-127 and the MCU 129.

A programmable microcontroller, such as the MCU 129, typically comprises a programmable processor and includes or has coupled thereto random-access memory (RAM) for storing data and read-only memory (ROM) and/or electrically erasable read only memory (EEROM) for storing control programming and any pre-defined operational parameters, such as pre-established light 'recipes' or dynamic color variation 'routines.' The MCU 129 itself comprises registers and other components for implementing a central processing unit (CPU) and possibly an associated arithmetic logic unit. The CPU implements the program to process data in the desired manner and thereby generates desired control outputs to cause the system to generate a virtual source of a desired output characteristic.

The MCU 129 is programmed to control the LED driver circuits 121-127 to set the individual output intensities of the LEDs to desired levels in response to predefined commands, so that the combined light emitted from the aperture of the cavity has a desired spectral characteristic and a desired overall intensity. Although other algorithms may be implemented by programming the MCU 129, in a variable color lighting example, the MCU 129 receives commands representing appropriate RGB intensity settings and converts those to appropriate driver settings for the respective groups 113 to 119 of the LEDs in the array 111.

The electrical components may also include one or more feedback sensors 143, to provide system performance measurements as feedback signals to the control logic, implemented in this example by the MCU 129. A variety of different sensors may be used, alone or in combination, for different applications. In the illustrated examples, the set 143 of feedback sensors includes a color and intensity sensor 145 and a temperature sensor 147. Although not shown, other sensors, such as a separate overall intensity sensor may be used. The sensors are positioned in or around the fixture to measure the appropriate physical condition, e.g. temperature, color, intensity, etc.

The sensor 145, for example, is coupled to detect color distribution in the integrated light energy. The sensor 145 may be coupled to sense energy within the optical integrating cavity, within the deflector (if provided) or at a point in the field illuminated by the particular system. Various examples of appropriate color sensors are known. For example, the sensor 145 may be a digital compatible sensor, of the type sold by TAOS, Inc. Another suitable sensor might use the quadrant light detector disclosed in U.S. Pat. No. 5,877,490, with appropriate color separation on the various light detector elements (see U.S. Pat. No. 5,914,487 for discussion of the color analysis).

The associated logic circuitry, responsive to the detected color distribution, controls the output intensity of the various LEDs, so as to provide a desired color distribution in the integrated light energy, in accord with appropriate settings. In an example using sleeper LEDs, the logic circuitry also is responsive to the detected color distribution and/or overall intensity to selectively activate the inactive light emitting diodes as needed, to maintain the desired color distribution in integrated light energy at a desired intensity. The sensor 145 measures the color of the integrated light energy and possibly overall intensity of the light produced by the system and provides measurement signals to the MCU 129. If using the TAOS, Inc. color sensor, for example, the signal is a digital signal derived from a color to frequency conversion, wherein the pulse frequency corresponds to measured intensity. The TAOS sensor is responsive to instructions from the MCU 129 to selectively measure overall intensity, Red intensity, Green intensity and Blue intensity.

The temperature sensor 147 may be a simple thermoelectric transducer with an associated analog to digital converter, or a variety of other temperature detectors may be used. The temperature sensor is positioned on or inside of the fixture, typically at a point that is near the LEDs or other sources that produce most of the system heat. The temperature sensor 147 provides a signal representing the measured temperature to the MCU 129. The system logic, here implemented by the MCU 129, can adjust intensity of one or more of the LEDs in response to the sensed temperature, e.g. to reduce intensity of the source outputs to compensate for temperature increases. The program of the MCU 129, however, would typically manipulate the intensities of the various LEDs so as to maintain the desired color balance between the various wavelengths of light used in the system, even though it may vary the overall intensity with temperature. For example, if temperature is increasing due to increased drive current to the active LEDs (with increased age or heat), the controller may deactivate one or more of those LEDs and activate a corresponding number of the sleepers, since the newly activated sleeper(s) will provide similar output in response to lower current and thus produce less heat.

In a typical general lighting application in say an architectural setting, the fixture and associated solid state light engine 101 will be mounted or otherwise installed at a location of desired illumination. The light engine 101, however, will be activated and controlled by a controller 151, which may be at a separate location. For example, if the fixture containing the light engine 101 is installed in the ceiling of a room as a downlight for task or area illumination, the controller 151 might be mounted in a wall box near a door into the room, much like the mounting of a conventional ON-OFF wall switch for an incandescent or fluorescent light fixture. Those skilled in the art will recognize that the controller 151 may be mounted in close proximity to or integrated into the light engine 101. In some cases, the controller 151 may be at a substantial distance from the light engine. It is also conceivable that the separate controller 151 may be eliminated and the functionality implemented by a user interface on the light engine in combination with further programming of the MCU 129.

The circuitry of the light engine 101 includes a wired communication interface or transceiver 139 that enables communications to and/or from a transceiver 153, which provides communications with the micro-control unit (MCU) 155 in the controller 151. Typically, the controller will include one or more input and/or output elements for implementing a user interface 157. The user interface 157 may be as simple as a rotary switch or a set of pushbuttons. As another example, the controller 151 may also include a wireless transceiver, in this case, in the form of a Bluetooth transceiver 159. A number of light engines 101 of the type shown may connect over common wiring, so that one controller 151 through its transceiver 153 can provide instructions via interfaces 139 to the MCUs 129 in several such light engines, thereby providing common control of a number of light fixtures.

A programmable microcontroller, such as the MCU 155, typically comprises a programmable processor and includes or has coupled thereto random-access memory (RAM) for storing data and read-only memory (ROM) and/or electrically erasable read only memory (EEROM) for storing control programming and any pre-defined operational parameters, such as pre-established light 'recipes' or dynamic color variation 'routines.' In the example, the controller 151 is shown as having a memory 161, which will store programming and control data. The MCU 155 itself comprises registers and other components for implementing a central processing unit (CPU) and possibly an associated arithmetic logic unit. The CPU implements the program to process data in the desired manner and thereby generates desired control outputs to cause the controller 151 to generate commands to one or more light engines to provide general lighting operations of the one or more controlled light fixtures.

The MCU 155 may be programmed to essentially establish and maintain or preset a desired 'recipe' or mixture of the available wavelengths provided by the LEDs used in the particular system, to provide a desired intensity and/or spectral setting. For each such recipe, the MCU 155 will cause the transceiver 139 to send the appropriate command to the MCU 129 in the one or more light engines 101 under its control. Each fixture that receives such an instruction will implement the indicated setting and maintain the setting until instructed to change to a new setting. For some applications, the MCU 155 may work through a number of settings over a period of time in a manner defined by a dynamic routine. Data for such recipes or routines may be stored in the memory 161.

As noted, the controller 151 includes a Bluetooth type wireless transceiver 159 coupled to the MCU 155. The transceiver 159 supports two-way data communication in accord with the standard Bluetooth protocol. For purposes of the present discussion, this wireless communication link facilitates data communication with a personal digital assistant (PDA) 171. The PDA 171 is programmed to provide user input, programming and attendant program control of the system 100.

For example, preset color and intensity settings may be chosen from the PDA 171 and downloaded into the memory 161 in the controller 151. If a single preset is stored, the controller 151 will cause the light engine 101 to provide the corresponding light output, until the preset is rewritten in the memory. If a number of presets are stored in the memory 161 in the controller 151, the user interface 157 enables subsequent selection of one of the preset recipes for current illumination. The PDA also provides a mechanism to allow downloading of setting data for one or more lighting sequences to the controller memory.

The discussion of the specific examples so far has assumed that the light source comprised one or more solid state light sources, typically in the form of one or more LEDs. However, those skilled in the art will appreciate that the quantum dot liquid and associated diffuse reflective processing of light may be applied to light fixtures that use other types of sources. In general, any of the fixtures discussed above may be modified to use a different type of light source. To appreciate the point, it may be helpful to consider a couple of additional examples that utilize a mercury vapor lamp as the alternative light source.

Figure 16:
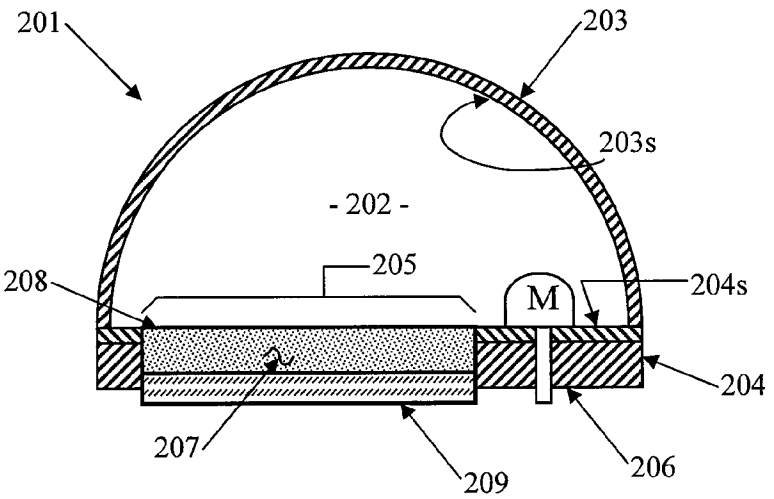
FIG. 16 is a cross section of a light fixture for a general lighting application, using an alternative light source (e.g. a mercury vapor lamp), an optical integrating cavity and a liquid containing quantum dots.

FIG. 16 therefore depicts a light fixture for a general lighting application, using a mercury vapor lamp (M) as the light source, an optical integrating cavity, a deflector or concentrator and a liquid containing phosphor quantum dots.

Hence, the solid state lighting fixture 201 of FIG. 16 includes a chamber, in this example, an optical integrating cavity 202 formed by a dome 203 and a plate 204. The cavity has one or more diffusely reflective interior surfaces 203*s*, 204*s* and a transmissive optical passage 205. The lighting apparatus 201 also includes a source of light of a first spectral characteristic of sufficient light intensity for a general lighting application, in this example, a mercury vapor lamp (M) 206. Diffuse reflections of light within the cavity 202 serve to integrate light and produce a substantially uniform virtual source at the aperture 205 as outlined above. The lighting fixture 201 utilizes quantum dots in a liquid 207 within a container 208, for producing a wavelength shift of at least some light from the lamp (M) 206, to produce a desired color characteristic in the processed light emitted from the optical passage 205 of the chamber 202. Elements and materials may be similar to those used in earlier examples, such as discussed above relative to FIGS. 1-3. A UV filter 209 may be provided, to block any UV light not processed by interaction with the quantum dots.

Some light entering the container 208 from the cavity 202 will pass through the liquid 207 without interacting with any of the quantum dots. Other light from the cavity 202 will interact with the quantum dots. Light that interacts with the quantum dots will be absorbed by the dots and re-emitted by the dots at a different wavelength. Some of the light emitted from the quantum dots in the liquid 207 will be emitted back into the cavity 202, for diffuse reflection and integration with light from the lamp 206, for later emission through the aperture 205, the liquid 207 and the light transmissive elements of the container 208. Other light emitted from the quantum dots in the liquid 207 will be emitted together with the light that is passing through the liquid 207 without interacting with any of the quantum dots. In this way, light emerging from the fixture 201 via the aperture, container and liquid will include some integrated light from within the cavity 202 as well as some light shifted by interaction (absorption and re-emission) via the quantum dots contained in the liquid. The spectrum of light emitted from the apparatus 201 thus includes at least some of the wavelengths of light from the mercury vapor lamp (M) 206 as well as one or more wavelengths of the light shifted by the quantum dots in the liquid 207. This combination of light provides the desired spectral characteristic of the fixture output, that is to say, for the intended general lighting application.

Figure 17:
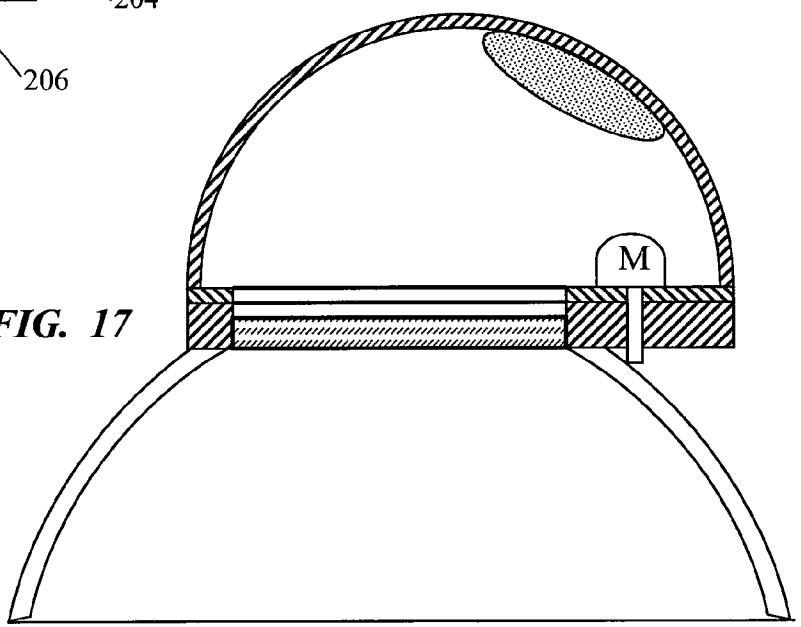
FIG. 17 is a cross section of a light fixture, similar to that of FIG. 13, but having a container of an arbitrary shape containing the quantum dots liquid, which is positioned on a portion of the interior surface of the cavity.

As in the examples of fixtures with solid state sources, fixtures with other type sources may use any of a variety of containers or other arrangements discussed herein to position the liquid in an appropriate location on or in relationship to the fixture. By way of just one example, FIG. 17 illustrates another light fixture, similar to that of FIG. 16, but having a container of an arbitrary shape containing the quantum dots liquid, which is positioned on a portion of the interior surface of the cavity. The container and liquid in this example function in a manner similar to those in the example of FIG. 8. This example also includes a deflector or concentrator coupled to the aperture of the optical integrating cavity. The deflector may be constructed of materials similar to those used for deflectors in several earlier examples. The deflector shape may be the similar to those discussed earlier, although other shapes may be used, as shown for example by the curved embodiment of the deflector in FIG. 17.

Figure 18:
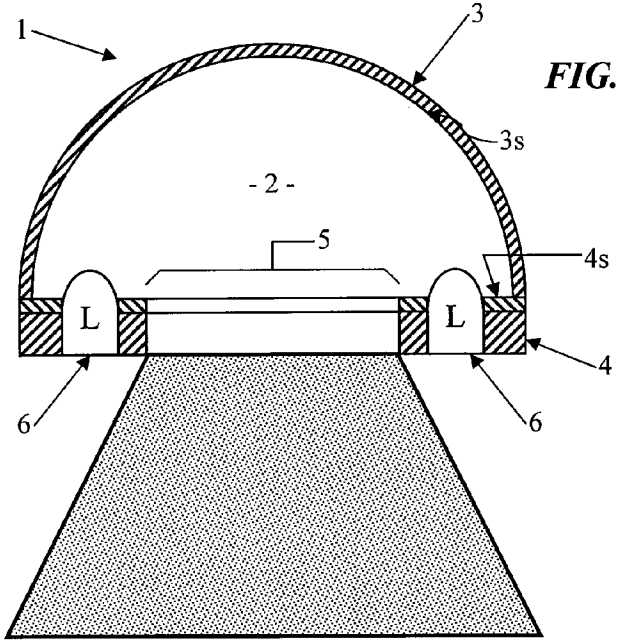
FIG. 18 is a cross section of another light fixture for a general lighting application, similar to the fixture of FIG. 1 but having the liquid container coupled to the aperture essentially in place of the deflector.

Those skilled in the art will recognize that liquid quantum dots may be used in or coupled to reflectors in light fixtures of a variety of other configurations, with solid state or other sources. FIG. 18 shows another light fixture for a general lighting application, similar to the fixture of FIG. 1 but having the liquid container coupled to the aperture essentially in place of the deflector. Here, the side surface(s) of the liquid container may be transparent or translucent or exhibit various shapes/textures, similar to the container included in or at the aperture as discussed above relative to FIGS. 1-3. However, here, an alternative approach would be to coat or treat the side surfaces of the container to exhibit reflectivity similar to that of the interior surface(s) of the deflector.

Figure 19:
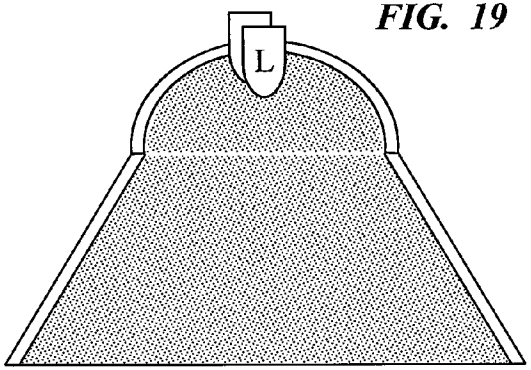
FIG. 19 is a cross section of another light fixture for a general lighting application, including a light source, a reflector and a liquid containing the quantum dots, in this case filling at least a substantial portion of the reflector.
Figure 21:
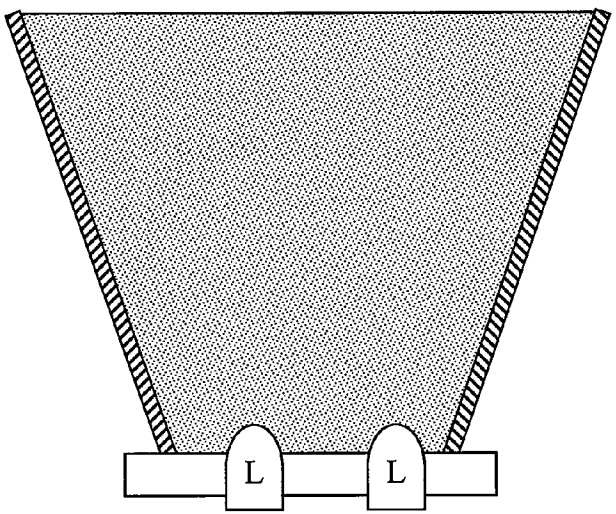
FIG. 21 is a cross section of another light fixture for a general lighting application, including a light source, a reflector and a quantum dot liquid, where the reflector is sealed to form the container for the liquid containing the quantum dots.
Figure 20:
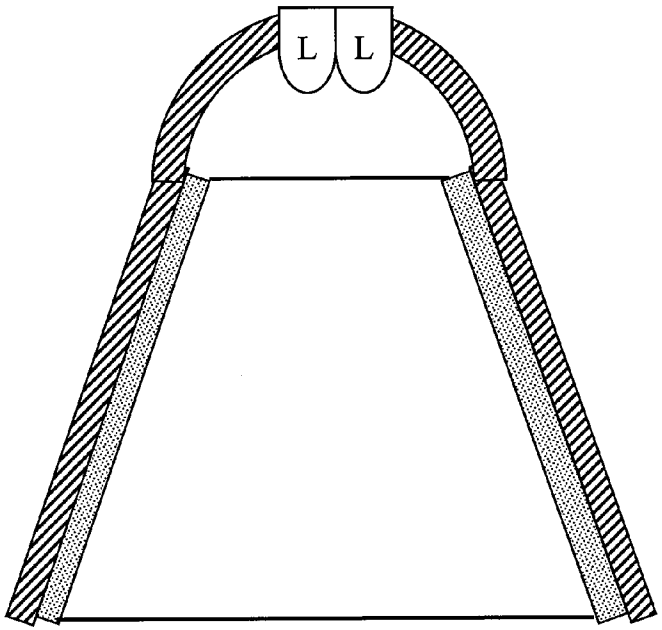
FIG. 20 is a cross section of another light fixture for a general lighting application, including a light source, a reflector and a container for the quantum dot liquid, where the container places the liquid containing the quantum dots adjacent to the reflective inner surface of the reflector.

In general, the discussion above has focused on examples that include a chamber or cavity. However, those skilled in the art will recognize that the quantum dot liquid may be utilized in fixtures that use other reflector configurations. To illustrate the point, just a few examples are shown in FIGS. 19-21. In these examples, each lighting apparatus for general lighting includes a source and a reflector. The source provides light of a first spectral characteristic of sufficient light intensity for a general lighting application. Although LED (L) type solid state sources are shown for convenience, as discussed above, the liquid may be used in fixtures that utilize other types of light sources. The reflector has a reflective interior surface for directing light from the source in a direction to facilitate said general lighting application in the region or area. The apparatus also includes a liquid containing quantum dots, for producing a wavelength shift of at least some of the light.

FIG. 19 is a cross section of another light fixture, in which the liquid containing the quantum dots fills at least a substantial portion of the reflector. The reflector may have any of a variety of shapes. The reflector is sealed to form the container for the liquid containing the quantum dots. FIG. 20 shows another example of a light fixture having a light source, a reflector and a container for the quantum dot liquid. In this example, the container places the liquid containing the quantum dots adjacent to the reflective inner surface of the reflector. FIG. 21 shows another example of a light fixture having a light source, a reflector and a quantum dot liquid. In this example, the fixture is somewhat similar to that of FIG. 11, without the dome shaped mask/cavity for constructive occlusion. Again, the reflector is sealed to form the container for the liquid containing the quantum dots.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A lighting apparatus for providing general lighting in a region or area intended to be occupied by a person, the lighting apparatus comprising:

a source of light of a first spectral characteristic of a light intensity for a general lighting application;

a reflector having a reflective interior surface for directing light from the source in a direction to facilitate said general lighting application in the region or area; and a liquid containing quantum dots, for producing a wavelength shift of at least some light from the source to produce a desired second color characteristic in light output from the lighting apparatus.

2. The lighting apparatus of claim 1, wherein the liquid containing quantum dots fills at least a substantial portion of the interior volume of the reflector.

3. The lighting apparatus of claim 1, further comprising:

a light transmissive container, forming a containment system enclosing the liquid, wherein the light transmissive container is positioned adjacent at least a portion of the reflective interior surface of the reflector.

4. A lighting apparatus for providing general lighting in a region or area intended to be occupied by a person, the lighting apparatus comprising:

a source of light of a first spectral characteristic of a light intensity for a general lighting application;

a chamber having a diffusely reflective interior surface and a transmissive optical passage, for receiving and diffusing light from the source, via multiple diffuse reflections from the reflective interior surface, to form processed light for emission via the optical passage in a direction to facilitate said general lighting application in the region or area; and a liquid containing quantum dots, for producing a wavelength shift of at least some light to produce a desired second color characteristic in the processed light emitted from the optical passage of the chamber.

5. The lighting apparatus of claim 4, wherein the source comprises one or more light emitting diodes.

6. The lighting apparatus of claim 4, wherein the source comprises a mercury vapor lamp.

7. The lighting apparatus of claim 4, wherein the diffusely reflective interior surface and the transmissive optical passage are arranged such that the chamber forms an optical integrating cavity.

8. A lighting apparatus for providing general lighting in a region or area intended to be occupied by a person, the lighting apparatus comprising:

a plurality of solid state light emitters producing a light intensity for a general lighting application;

an optical integrating cavity having a diffusely reflective interior surface and a transmissive optical passage, for receiving and integrating light from the solid state light emitters, via multiple diffuse reflections from the reflective interior surface, to form integrated light for emission via the optical passage in a direction to facilitate said general lighting application in the region or area; and a liquid containing quantum dots, responsive to at least some of the light, for producing a shift of one or more wavelengths of light included in the integrated light emitted from the optical passage of the cavity.

9. The lighting apparatus of claim 8, further comprising:

a light transmissive container, forming a containment system enclosing the liquid, wherein the light transmissive container is positioned at or in a path of light emitted from the optical passage of the optical integrating cavity.

10. The lighting apparatus of claim 8, further comprising:

a light transmissive container, forming a containment system enclosing the liquid, wherein the light transmissive container is positioned within the optical integrating cavity.

11. The lighting apparatus of claim 8, further comprising:

a light transmissive container, forming a containment system enclosing the liquid, wherein the light transmissive container is positioned adjacent a portion of the interior surface of the optical integrating cavity.

12. The lighting apparatus of claim 8, wherein the liquid containing quantum dots at least substantially fills an interior volume of the optical integrating cavity.

13. The lighting apparatus of claim 8, further comprising a mask positioned outside the cavity and having a reflective surface facing the optical passage for constructively occluding the optical passage with respect to a field to be illuminated by the lighting apparatus within the region or area.

14. The lighting apparatus of claim 8, in combination with circuitry for controlling operation of the one or more solid state light emitters.

15. The lighting apparatus of claim 8, wherein the liquid containing quantum dots is positioned on at least a portion of the diffusely reflective interior surface of the optical integrating cavity.

16. The lighting apparatus of claim 15, further comprising:

a light transmissive solid filling at least a substantial portion of the interior of the optical integrating cavity, wherein the liquid containing quantum dots is positioned between the solid and the portion of the diffusely reflective interior surface of the optical integrating cavity.

17. The lighting apparatus of claim 8, further comprising a deflector having a reflective interior surface coupled to the optical passage for concentrating light emitted from the optical passage over a field to be illuminated by the lighting apparatus.

18. The lighting apparatus of claim 17, wherein the liquid containing quantum dots is positioned on at least a portion of the reflective interior surface of the deflector.

19. A lighting apparatus, comprising:

a light fixture for providing general lighting in a region or area intended to be occupied by a person; and circuitry for controlling operation of the light fixture, wherein the light fixture comprises:

a plurality of solid state light emitters for producing a light intensity for a general lighting application, each solid state light emitter comprising a least one semiconductor chip connected to be driven by power supplied from the circuitry and a package enclosing the chip;

an optical integrating cavity having a diffusely reflective interior surface and a transmissive optical passage, for receiving and integrating light from the solid state light emitters, via multiple diffuse reflections from the reflective interior surface, to form integrated light for emission via the optical passage in a direction to facilitate said general lighting application in the region or area;

a liquid containing quantum dots responsive to at least some of the light, for producing a shift of one or more wavelengths of light, the liquid containing quantum dots being in the liquid state during operation of the apparatus; and a container forming a containment system enclosing the liquid, wherein:

at least one portion of the container is light transmissive to allow entry of light from the solid state light emitters into the interior volume of the container to excite the quantum dots in the liquid contained therein, and at least one portion of the container is light transmissive to allow emission of wavelength shifted light from the interior volume of the container produced by excited quantum dots.

20. The lighting apparatus of claim 19, wherein the container is positioned in the fixture so that the liquid containing quantum dots is at or near at least a portion of the diffusely reflective interior surface of the optical integrating cavity.

21. The lighting apparatus of claim 19, wherein the container is positioned at or in a path of light emitted from the transmissive optical passage of the optical integrating cavity.

22. The lighting apparatus of claim 19, wherein the light transmissive container is positioned within the optical integrating cavity.

23. The lighting apparatus of claim 19, wherein the liquid containing quantum dots at least substantially fills an interior volume of the optical integrating cavity.

24. The lighting apparatus of claim 19, further comprising a mask positioned outside the cavity and having a reflective surface facing the optical passage for constructively occluding the optical passage with respect to a field to be illuminated by the lighting apparatus within the region or area.

25. The lighting apparatus of claim 19, further comprising a deflector having a reflective interior surface coupled to the optical passage for concentrating light emitted from the optical passage over a field to be illuminated by the lighting apparatus within the region or area.

26. The lighting apparatus of claim 25, wherein the container is positioned in the fixture so that the liquid containing quantum dots is at or near at least a portion of the reflective interior surface of the deflector.

* * * * *